US011516603B2

(12) United States Patent
Dy et al.

(10) Patent No.: US 11,516,603 B2
(45) Date of Patent: Nov. 29, 2022

(54) CONTACT HEARING DEVICE AND RETENTION STRUCTURE MATERIALS

(71) Applicant: Earlens Corporation, Menlo Park, CA (US)

(72) Inventors: Peter Dy, Milpitas, CA (US); Rodney Perkins, Woodside, CA (US); James Silver, Palo Alto, CA (US); Jake Olsen, Palo Alto, CA (US); Paul Rucker, San Francisco, CA (US); Kyle Imatani, Mountain View, CA (US); Bryan Flaherty, Mountain View, CA (US); Daniel Hallock, Redwood City, CA (US); Iljong Lee, Saratoga, CA (US); Ketan Muni, San Jose, CA (US)

(73) Assignee: Earlens Corporation, Menlo Park, CA (US)

( * ) Notice: Subject to any disclaimer, the term of this patent is extended or adjusted under 35 U.S.C. 154(b) by 125 days.

(21) Appl. No.: 17/007,800

(22) Filed: Aug. 31, 2020

(65) Prior Publication Data

US 2020/0396551 A1 Dec. 17, 2020

Related U.S. Application Data

(63) Continuation of application No. PCT/US2019/020942, filed on Mar. 6, 2019.
(Continued)

(51) Int. Cl.
*H04R 25/00* (2006.01)
*H04R 31/00* (2006.01)

(52) U.S. Cl.
CPC ..... *H04R 25/604* (2013.01); *H04R 25/652* (2013.01); *H04R 31/00* (2013.01); *H04R 2231/003* (2013.01)

(58) Field of Classification Search
CPC ..... H04R 25/505; H04R 25/554; H04R 2225/55; H04R 2430/01; H04R 25/70; H04R 25/55
See application file for complete search history.

(56) References Cited

U.S. PATENT DOCUMENTS 2,763,334 A 9/1956 Starkey
3,209,082 A 9/1965 McCarrell et al.
(Continued)

FOREIGN PATENT DOCUMENTS

AU 2004301961 A1 2/2005
CA 2242545 C 9/2009
(Continued)

OTHER PUBLICATIONS

Asbeck, et al. Scaling Hard Vertical Surfaces with Compliant Microspine Arrays, The International Journal of Robotics Research 2006; 25; 1165-79.
(Continued)

*Primary Examiner* — Amir H Etesam
(74) *Attorney, Agent, or Firm* — Wilson Sonsini Goodrich & Rosati, P.C.

(57) ABSTRACT

Hearing aid devices, methods of manufacture, methods of use, and kits are provided. In certain aspects, the hearing aid devices comprise an apparatus having a transducer and a retention structure comprising a shape profile corresponding to a tissue of the user, and a layer of elastomer.

29 Claims, 6 Drawing Sheets

Related U.S. Application Data

(60) Provisional application No. 62/639,796, filed on Mar. 7, 2018.

(56) References Cited

U.S. PATENT DOCUMENTS

| | | | |
|---|---|---|---|
| 3,229,049 | A | 1/1966 | Goldberg |
| 3,440,314 | A | 4/1969 | Eldon |
| 3,449,768 | A | 6/1969 | Doyle et al. |
| 3,526,949 | A | 9/1970 | Genovese |
| 3,549,818 | A | 12/1970 | Turner |
| 3,585,416 | A | 6/1971 | Mellen |
| 3,594,514 | A | 7/1971 | Wingrove |
| 3,710,399 | A | 1/1973 | Hurst |
| 3,712,962 | A | 1/1973 | Epley |
| 3,764,748 | A | 10/1973 | Branch et al. |
| 3,808,179 | A | 4/1974 | Gaylord |
| 3,870,832 | A | 3/1975 | Fredrickson |
| 3,882,285 | A | 5/1975 | Nunley et al. |
| 3,965,430 | A | 6/1976 | Brandt |
| 3,985,977 | A | 10/1976 | Beaty et al. |
| 4,002,897 | A | 1/1977 | Kleinman et al. |
| 4,031,318 | A | 6/1977 | Pitre |
| 4,061,972 | A | 12/1977 | Burgess |
| 4,075,042 | A | 2/1978 | Das |
| 4,098,277 | A | 7/1978 | Mendell |
| 4,109,116 | A | 8/1978 | Victoreen |
| 4,120,570 | A | 10/1978 | Gaylord |
| 4,207,441 | A | 6/1980 | Ricard et al. |
| 4,248,899 | A | 2/1981 | Lyon et al. |
| 4,252,440 | A | 2/1981 | Fedors et al. |
| 4,281,419 | A | 8/1981 | Treace |
| 4,303,772 | A | 12/1981 | Novicky |
| 4,319,359 | A | 3/1982 | Wolf |
| 4,334,315 | A | 6/1982 | Ono et al. |
| 4,334,321 | A | 6/1982 | Edelman |
| 4,338,929 | A | 7/1982 | Lundin et al. |
| 4,339,954 | A | 7/1982 | Anson et al. |
| 4,357,497 | A | 11/1982 | Hochmair et al. |
| 4,375,016 | A | 2/1983 | Harada |
| 4,380,689 | A | 4/1983 | Giannetti |
| 4,428,377 | A | 1/1984 | Zollner et al. |
| 4,524,294 | A | 6/1985 | Brody |
| 4,540,761 | A | 9/1985 | Kawamura et al. |
| 4,556,122 | A | 12/1985 | Goode |
| 4,592,087 | A | 5/1986 | Killion |
| 4,606,329 | A | 8/1986 | Hough |
| 4,611,598 | A | 9/1986 | Hortmann et al. |
| 4,628,907 | A | 12/1986 | Epley |
| 4,641,377 | A | 2/1987 | Rush et al. |
| 4,652,414 | A | 3/1987 | Schlaegel |
| 4,654,554 | A | 3/1987 | Kishi |
| 4,689,819 | A | 8/1987 | Killion |
| 4,696,287 | A | 9/1987 | Hortmann et al. |
| 4,729,366 | A | 3/1988 | Schaefer |
| 4,741,339 | A | 5/1988 | Harrison et al. |
| 4,742,499 | A | 5/1988 | Butler |
| 4,756,312 | A | 7/1988 | Epley |
| 4,759,070 | A | 7/1988 | Voroba et al. |
| 4,766,607 | A | 8/1988 | Feldman |
| 4,774,933 | A | 10/1988 | Hough et al. |
| 4,776,322 | A | 10/1988 | Hough et al. |
| 4,782,818 | A | 11/1988 | Mori |
| 4,800,884 | A | 1/1989 | Heide et al. |
| 4,800,982 | A | 1/1989 | Carlson |
| 4,817,607 | A | 4/1989 | Tatge |
| 4,840,178 | A | 6/1989 | Heide et al. |
| 4,845,755 | A | 7/1989 | Busch et al. |
| 4,865,035 | A | 9/1989 | Mori |
| 4,870,688 | A | 9/1989 | Voroba et al. |
| 4,918,745 | A | 4/1990 | Hutchison |
| 4,932,405 | A | 6/1990 | Peeters et al. |
| 4,936,305 | A | 6/1990 | Ashtiani et al. |
| 4,944,301 | A | 7/1990 | Widin et al. |
| 4,948,855 | A | 8/1990 | Novicky |
| 4,957,478 | A | 9/1990 | Maniglia et al. |
| 4,963,963 | A | 10/1990 | Dorman |
| 4,982,434 | A | 1/1991 | Lenhardt et al. |
| 4,999,819 | A | 3/1991 | Newnham et al. |
| 5,003,608 | A | 3/1991 | Carlson |
| 5,012,520 | A | 4/1991 | Steeger |
| 5,015,224 | A | 5/1991 | Maniglia |
| 5,015,225 | A | 5/1991 | Hough et al. |
| 5,031,219 | A | 7/1991 | Ward et al. |
| 5,061,282 | A | 10/1991 | Jacobs |
| 5,066,091 | A | 11/1991 | Stoy et al. |
| 5,068,902 | A | 11/1991 | Ward |
| 5,094,108 | A | 3/1992 | Kim et al. |
| 5,117,461 | A | 5/1992 | Moseley |
| 5,142,186 | A | 8/1992 | Cross et al. |
| 5,163,957 | A | 11/1992 | Sade et al. |
| 5,167,235 | A | 12/1992 | Seacord et al. |
| 5,201,007 | A | 4/1993 | Ward et al. |
| 5,220,612 | A | 6/1993 | Tibbetts et al. |
| 5,259,032 | A | 11/1993 | Perkins et al. |
| 5,272,757 | A | 12/1993 | Scofield et al. |
| 5,276,910 | A | 1/1994 | Buchele |
| 5,277,694 | A | 1/1994 | Leysieffer et al. |
| 5,282,858 | A | 2/1994 | Bisch et al. |
| 5,296,797 | A | 3/1994 | Bartlett |
| 5,298,692 | A | 3/1994 | Ikeda et al. |
| 5,338,287 | A | 8/1994 | Miller et al. |
| 5,360,388 | A | 11/1994 | Spindel et al. |
| 5,378,933 | A | 1/1995 | Pfannenmueller et al. |
| 5,402,496 | A | 3/1995 | Soli et al. |
| 5,411,467 | A | 5/1995 | Hortmann et al. |
| 5,424,698 | A | 6/1995 | Dydyk et al. |
| 5,425,104 | A | 6/1995 | Shennib et al. |
| 5,440,082 | A | 8/1995 | Claes |
| 5,440,237 | A | 8/1995 | Brown et al. |
| 5,455,994 | A | 10/1995 | Termeer et al. |
| 5,456,654 | A | 10/1995 | Ball |
| 5,531,787 | A | 7/1996 | Lesinski et al. |
| 5,531,954 | A | 7/1996 | Heide et al. |
| 5,535,282 | A | 7/1996 | Luca |
| 5,554,096 | A | 9/1996 | Ball |
| 5,558,618 | A | 9/1996 | Maniglia |
| 5,571,148 | A | 11/1996 | Loeb et al. |
| 5,572,594 | A | 11/1996 | Devoe et al. |
| 5,606,621 | A | 2/1997 | Reiter et al. |
| 5,624,376 | A | 4/1997 | Ball et al. |
| 5,654,530 | A | 8/1997 | Sauer et al. |
| 5,692,059 | A | 11/1997 | Kruger |
| 5,699,809 | A | 12/1997 | Combs et al. |
| 5,701,348 | A | 12/1997 | Shennib et al. |
| 5,707,338 | A | 1/1998 | Adams et al. |
| 5,715,321 | A | 2/1998 | Andrea et al. |
| 5,721,783 | A | 2/1998 | Anderson |
| 5,722,411 | A | 3/1998 | Suzuki et al. |
| 5,729,077 | A | 3/1998 | Newnham et al. |
| 5,740,258 | A | 4/1998 | Goodwin-Johansson |
| 5,742,692 | A | 4/1998 | Garcia et al. |
| 5,749,912 | A | 5/1998 | Zhang et al. |
| 5,762,583 | A | 6/1998 | Adams et al. |
| 5,772,575 | A | 6/1998 | Lesinski et al. |
| 5,774,259 | A | 6/1998 | Saitoh et al. |
| 5,782,744 | A | 7/1998 | Money |
| 5,788,711 | A | 8/1998 | Lehner et al. |
| 5,795,287 | A | 8/1998 | Ball et al. |
| 5,797,834 | A | 8/1998 | Goode |
| 5,800,336 | A | 9/1998 | Ball et al. |
| 5,804,109 | A | 9/1998 | Perkins |
| 5,804,907 | A | 9/1998 | Park et al. |
| 5,814,095 | A | 9/1998 | Mueller et al. |
| 5,824,022 | A | 10/1998 | Zilberman et al. |
| 5,825,122 | A | 10/1998 | Givargizov et al. |
| 5,836,863 | A | 11/1998 | Bushek et al. |
| 5,842,967 | A | 12/1998 | Kroll |
| 5,851,199 | A | 12/1998 | Peerless et al. |
| 5,857,958 | A | 1/1999 | Ball et al. |
| 5,859,916 | A | 1/1999 | Ball et al. |
| 5,868,682 | A | 2/1999 | Combs et al. |
| 5,879,283 | A | 3/1999 | Adams et al. |
| 5,888,187 | A | 3/1999 | Jaeger et al. |
| 5,897,486 | A | 4/1999 | Ball et al. |

(56) References Cited

U.S. PATENT DOCUMENTS 5,899,847 A 5/1999 Adams et al.
5,900,274 A 5/1999 Chatterjee et al.
5,906,635 A 5/1999 Maniglia
5,913,815 A 6/1999 Ball et al.
5,922,017 A 7/1999 Bredberg et al.
5,922,077 A 7/1999 Espy et al.
5,935,170 A 8/1999 Haakansson et al.
5,940,519 A 8/1999 Kuo
5,949,895 A 9/1999 Ball et al.
5,951,601 A 9/1999 Lesinski et al.
5,984,859 A 11/1999 Lesinski
5,987,146 A 11/1999 Pluvinage et al.
6,001,129 A 12/1999 Bushek et al.
6,005,955 A 12/1999 Kroll et al.
6,011,984 A 1/2000 Van Antwerp et al.
6,024,717 A 2/2000 Ball et al.
6,038,480 A 3/2000 Hrdlicka et al.
6,045,528 A 4/2000 Arenberg et al.
6,050,933 A 4/2000 Bushek et al.
6,067,474 A 5/2000 Schulman et al.
6,068,589 A 5/2000 Neukermans
6,068,590 A 5/2000 Brisken
6,072,884 A 6/2000 Kates
6,084,975 A 7/2000 Perkins
6,093,144 A 7/2000 Jaeger et al.
6,135,612 A 10/2000 Clore
6,137,889 A 10/2000 Shennib et al.
6,139,488 A 10/2000 Ball
6,153,966 A 11/2000 Neukermans
6,168,948 B1 1/2001 Anderson et al.
6,174,278 B1 1/2001 Jaeger et al.
6,175,637 B1 1/2001 Fujihira et al.
6,181,801 B1 1/2001 Puthuff et al.
6,190,305 B1 2/2001 Ball et al.
6,190,306 B1 2/2001 Kennedy
6,208,445 B1 3/2001 Reime
6,216,040 B1 4/2001 Harrison
6,217,508 B1 4/2001 Ball et al.
6,219,427 B1 4/2001 Kates et al.
6,222,302 B1 4/2001 Imada et al.
6,222,927 B1 4/2001 Feng et al.
6,240,192 B1 5/2001 Brennan et al.
6,241,767 B1 6/2001 Stennert et al.
6,259,951 B1 7/2001 Kuzma et al.
6,261,224 B1 7/2001 Adams et al.
6,264,603 B1 7/2001 Kennedy
6,277,148 B1 8/2001 Dormer
6,312,959 B1 11/2001 Datskos
6,339,648 B1 1/2002 McIntosh et al.
6,342,035 B1 1/2002 Kroll et al.
6,354,990 B1 3/2002 Juneau et al.
6,359,993 B2 3/2002 Brimhall
6,366,863 B1 4/2002 Bye et al.
6,374,143 B1 4/2002 Berrang et al.
6,385,363 B1 5/2002 Rajic et al.
6,387,039 B1 5/2002 Moses
6,390,971 B1 5/2002 Adams et al.
6,393,130 B1 5/2002 Stonikas et al.
6,422,991 B1 7/2002 Jaeger
6,432,248 B1 8/2002 Popp et al.
6,434,246 B1 8/2002 Kates et al.
6,434,247 B1 8/2002 Kates et al.
6,436,028 B1 8/2002 Dormer
6,438,244 B1 8/2002 Juneau et al.
6,445,799 B1 9/2002 Taenzer et al.
6,473,512 B1 10/2002 Juneau et al.
6,475,134 B1 11/2002 Ball et al.
6,491,622 B1 12/2002 Kasic, II et al.
6,491,644 B1 12/2002 Vujanic et al.
6,491,722 B1 12/2002 Kroll et al.
6,493,453 B1 12/2002 Glendon
6,493,454 B1 12/2002 Loi et al.
6,498,858 B2 12/2002 Kates
6,507,758 B1 1/2003 Greenberg et al.
6,519,376 B2 2/2003 Biagi et al.
6,523,985 B2 2/2003 Hamanaka et al.
6,536,530 B2 3/2003 Schultz et al.
6,537,200 B2 3/2003 Leysieffer et al.
6,547,715 B1 4/2003 Mueller et al.
6,549,633 B1 4/2003 Westermann
6,549,635 B1 4/2003 Gebert
6,554,761 B1 4/2003 Puria et al.
6,575,894 B2 6/2003 Leysieffer et al.
6,592,513 B1 7/2003 Kroll et al.
6,603,860 B1 8/2003 Taenzer et al.
6,620,110 B2 9/2003 Schmid
6,626,822 B1 9/2003 Jaeger et al.
6,629,922 B1 10/2003 Puria et al.
6,631,196 B1 10/2003 Taenzer et al.
6,643,378 B2 11/2003 Schumaier
6,663,575 B2 12/2003 Leysieffer
6,668,062 B1 12/2003 Luo et al.
6,676,592 B2 1/2004 Ball et al.
6,681,022 B1 1/2004 Puthuff et al.
6,695,943 B2 2/2004 Juneau et al.
6,697,674 B2 2/2004 Leysieffer
6,724,902 B1 4/2004 Shennib et al.
6,726,618 B2 4/2004 Miller
6,726,718 B1 4/2004 Carlyle et al.
6,727,789 B2 4/2004 Tibbetts et al.
6,728,024 B2 4/2004 Ribak
6,735,318 B2 5/2004 Cho
6,754,358 B1 6/2004 Boesen et al.
6,754,359 B1 6/2004 Svean et al.
6,754,537 B1 6/2004 Harrison et al.
6,785,394 B1 8/2004 Olsen et al.
6,792,114 B1 9/2004 Kates et al.
6,801,629 B2 10/2004 Brimhall et al.
6,829,363 B2 12/2004 Sacha
6,831,986 B2 12/2004 Kates
6,837,857 B2 1/2005 Stirnemann
6,842,647 B1 1/2005 Griffith et al.
6,888,949 B1 5/2005 Vanden Berghe et al.
6,900,926 B2 5/2005 Ribak
6,912,289 B2 6/2005 Vonlanthen et al.
6,920,340 B2 7/2005 Laderman
6,931,231 B1 8/2005 Griffin
6,940,988 B1 9/2005 Shennib et al.
6,940,989 B1 9/2005 Shennib et al.
6,942,989 B2 * 9/2005 Felkner ..... C12Q 1/22 435/31
D512,979 S 12/2005 Corcoran et al.
6,975,402 B2 12/2005 Bisson et al.
6,978,159 B2 12/2005 Feng et al.
7,020,297 B2 3/2006 Fang et al.
7,024,010 B2 4/2006 Saunders et al.
7,043,037 B2 5/2006 Lichtblau et al.
7,050,675 B2 5/2006 Zhou et al.
7,050,876 B1 5/2006 Fu et al.
7,057,256 B2 6/2006 Mazur et al.
7,058,182 B2 6/2006 Kates
7,058,188 B1 6/2006 Allred
7,072,475 B1 7/2006 Denap et al.
7,076,076 B2 7/2006 Bauman
7,095,981 B1 8/2006 Voroba et al.
7,167,572 B1 1/2007 Harrison et al.
7,174,026 B2 2/2007 Niederdrank et al.
7,179,238 B2 2/2007 Hissong
7,181,034 B2 2/2007 Armstrong
7,203,331 B2 4/2007 Boesen
7,239,069 B2 7/2007 Cho
7,245,732 B2 7/2007 Jorgensen et al.
7,255,457 B2 8/2007 Ducharme et al.
7,266,208 B2 9/2007 Charvin et al.
7,289,639 B2 10/2007 Abel et al.
7,313,245 B1 12/2007 Shennib
7,315,211 B1 1/2008 Lee et al.
7,322,930 B2 1/2008 Jaeger et al.
7,349,741 B2 3/2008 Maltan et al.
7,354,792 B2 4/2008 Mazur et al.
7,376,563 B2 5/2008 Leysieffer et al.
7,390,689 B2 6/2008 Mazur et al.
7,394,909 B1 7/2008 Widmer et al.
7,421,087 B2 9/2008 Perkins et al.

(56) References Cited

U.S. PATENT DOCUMENTS 7,424,122 B2 9/2008 Ryan
7,444,877 B2 11/2008 Li et al.
7,547,275 B2 6/2009 Cho et al.
7,630,646 B2 12/2009 Anderson et al.
7,645,877 B2 1/2010 Gmeiner et al.
7,668,325 B2 2/2010 Puria et al.
7,747,295 B2 6/2010 Choi
7,778,434 B2 8/2010 Juneau et al.
7,809,150 B2 10/2010 Natarajan et al.
7,822,215 B2 10/2010 Carazo et al.
7,826,632 B2 11/2010 Von Buol et al.
7,853,033 B2 12/2010 Maltan et al.
7,867,160 B2 1/2011 Pluvinage et al.
7,883,535 B2 2/2011 Cantin et al.
7,885,359 B2 2/2011 Meltzer
7,955,249 B2 6/2011 Perkins et al.
7,983,435 B2 7/2011 Moses
8,090,134 B2 1/2012 Takigawa et al.
8,099,169 B1 1/2012 Karunasiri
8,116,494 B2 2/2012 Rass
8,128,551 B2 3/2012 Jolly
8,157,730 B2 4/2012 LeBoeuf et al.
8,197,461 B1 6/2012 Arenberg et al.
8,204,786 B2 6/2012 LeBoeuf et al.
8,233,651 B1 7/2012 Haller
8,251,903 B2 8/2012 LeBoeuf et al.
8,284,970 B2 10/2012 Sacha
8,295,505 B2 10/2012 Weinans et al.
8,295,523 B2 10/2012 Fay et al.
8,320,601 B2 11/2012 Takigawa et al.
8,320,982 B2 11/2012 LeBoeuf et al.
8,340,310 B2 12/2012 Ambrose et al.
8,340,335 B1 12/2012 Shennib
8,391,527 B2 3/2013 Feucht et al.
8,396,235 B2 3/2013 Gebhardt et al.
8,396,239 B2 3/2013 Fay et al.
8,401,212 B2 3/2013 Puria et al.
8,401,214 B2 3/2013 Perkins et al.
8,506,473 B2 8/2013 Puria
8,512,242 B2 8/2013 LeBoeuf et al.
8,526,651 B2 9/2013 Lafort et al.
8,526,652 B2 9/2013 Ambrose et al.
8,526,971 B2 9/2013 Giniger et al.
8,545,383 B2 10/2013 Wenzel et al.
8,600,089 B2 12/2013 Wenzel et al.
8,647,270 B2 2/2014 LeBoeuf et al.
8,652,040 B2 2/2014 LeBoeuf et al.
8,684,922 B2 4/2014 Tran
8,696,054 B2 4/2014 Crum
8,696,541 B2 4/2014 Pluvinage et al.
8,700,111 B2 4/2014 LeBoeuf et al.
8,702,607 B2 4/2014 LeBoeuf et al.
8,715,152 B2 5/2014 Puria et al.
8,715,153 B2 5/2014 Puria et al.
8,715,154 B2 5/2014 Perkins et al.
8,761,423 B2 6/2014 Wagner et al.
8,787,609 B2 7/2014 Perkins et al.
8,788,002 B2 7/2014 LeBoeuf et al.
8,817,998 B2 8/2014 Inoue
8,824,715 B2 9/2014 Fay et al.
8,837,758 B2 9/2014 Knudsen
8,845,705 B2 9/2014 Perkins et al.
8,855,323 B2 10/2014 Kroman
8,858,419 B2 10/2014 Puria et al.
8,885,860 B2 11/2014 Djalilian et al.
8,886,269 B2 11/2014 LeBoeuf et al.
8,888,701 B2 11/2014 LeBoeuf et al.
8,923,941 B2 12/2014 LeBoeuf et al.
8,929,965 B2 1/2015 LeBoeuf et al.
8,929,966 B2 1/2015 LeBoeuf et al.
8,934,952 B2 1/2015 LeBoeuf et al.
8,942,776 B2 1/2015 LeBoeuf et al.
8,961,415 B2 2/2015 LeBoeuf et al.
8,986,187 B2 3/2015 Perkins et al.
8,989,830 B2 3/2015 LeBoeuf et al.
9,044,180 B2 6/2015 LeBoeuf et al.
9,049,528 B2 6/2015 Fay et al.
9,055,379 B2 6/2015 Puria et al.
9,131,312 B2 9/2015 LeBoeuf et al.
9,154,891 B2 10/2015 Puria et al.
9,211,069 B2 12/2015 Larsen et al.
9,226,083 B2 12/2015 Puria et al.
9,277,335 B2 3/2016 Perkins et al.
9,289,135 B2 3/2016 LeBoeuf et al.
9,289,175 B2 3/2016 LeBoeuf et al.
9,301,696 B2 4/2016 LeBoeuf et al.
9,314,167 B2 4/2016 LeBoeuf et al.
9,392,377 B2 7/2016 Olsen et al.
9,427,191 B2 8/2016 LeBoeuf
9,497,556 B2 11/2016 Kaltenbacher et al.
9,521,962 B2 12/2016 LeBoeuf
9,524,092 B2 12/2016 Ren et al.
9,538,921 B2 1/2017 LeBoeuf et al.
9,544,700 B2 1/2017 Puria et al.
9,564,862 B2 2/2017 Hoyerby
9,591,409 B2 3/2017 Puria et al.
9,749,758 B2 8/2017 Puria et al.
9,750,462 B2 9/2017 LeBoeuf et al.
9,788,785 B2 10/2017 LeBoeuf
9,788,794 B2 10/2017 LeBoeuf et al.
9,794,653 B2 10/2017 Aumer et al.
9,794,688 B2 10/2017 You
9,801,552 B2 10/2017 Romesburg
9,808,204 B2 11/2017 LeBoeuf et al.
9,924,276 B2 3/2018 Wenzel
9,930,458 B2 3/2018 Freed et al.
9,949,035 B2 4/2018 Rucker et al.
9,949,039 B2 4/2018 Perkins et al.
9,949,045 B2 4/2018 Kure et al.
9,961,454 B2 5/2018 Puria et al.
9,964,672 B2 5/2018 Phair et al.
10,003,888 B2 6/2018 Stephanou et al.
10,034,103 B2 7/2018 Puria et al.
10,143,592 B2 * 12/2018 Goldstein ..... A61F 11/10
10,154,352 B2 12/2018 Perkins et al.
10,178,483 B2 1/2019 Teran et al.
10,206,045 B2 2/2019 Kaltenbacher et al.
10,237,663 B2 3/2019 Puria et al.
10,284,964 B2 5/2019 Olsen et al.
10,286,215 B2 5/2019 Perkins et al.
10,292,601 B2 5/2019 Perkins et al.
10,306,381 B2 5/2019 Sandhu et al.
10,492,010 B2 11/2019 Rucker et al.
10,511,913 B2 12/2019 Puria et al.
10,516,946 B2 12/2019 Puria et al.
10,516,949 B2 12/2019 Puria et al.
10,516,950 B2 12/2019 Perkins et al.
10,516,951 B2 12/2019 Wenzel
10,531,206 B2 1/2020 Freed et al.
10,555,100 B2 2/2020 Perkins et al.
10,609,492 B2 3/2020 Olsen et al.
10,743,110 B2 8/2020 Puria et al.
10,779,094 B2 9/2020 Rucker et al.
10,863,286 B2 12/2020 Perkins et al.
11,057,714 B2 7/2021 Puria et al.
11,058,305 B2 7/2021 Perkins et al.
11,070,927 B2 7/2021 Rucker et al.
11,102,594 B2 8/2021 Shaquer et al.
11,153,697 B2 10/2021 Olsen et al.
11,166,114 B2 11/2021 Perkins et al.
11,212,626 B2 12/2021 Larkin et al.
11,252,516 B2 2/2022 Wenzel
11,259,129 B2 2/2022 Freed et al.
11,310,605 B2 4/2022 Puria et al.
11,317,224 B2 4/2022 Puria
11,337,012 B2 5/2022 Atamaniuk et al.
11,350,226 B2 5/2022 Sandhu et al.
2001/0003788 A1 6/2001 Ball et al.
2001/0007050 A1 7/2001 Adelman
2001/0024507 A1 9/2001 Boesen
2001/0027342 A1 10/2001 Dormer
2001/0029313 A1 10/2001 Kennedy
2001/0053871 A1 12/2001 Zilberman et al.
2002/0025055 A1 2/2002 Stonikas et al.

(56) References Cited

U.S. PATENT DOCUMENTS

2002/0035309 A1 3/2002 Leysieffer
2002/0048374 A1 4/2002 Soli et al.
2002/0085728 A1 7/2002 Shennib et al.
2002/0086715 A1 7/2002 Sahagen
2002/0172350 A1 11/2002 Edwards et al.
2002/0183587 A1 12/2002 Dormer
2003/0021903 A1 1/2003 Shlenker et al.
2003/0055311 A1 3/2003 Neukermans et al.
2003/0064746 A1 4/2003 Rader et al.
2003/0081803 A1 5/2003 Petilli et al.
2003/0097178 A1 5/2003 Roberson et al.
2003/0125602 A1 7/2003 Sokolich et al.
2003/0142841 A1 7/2003 Wiegand
2003/0208099 A1 11/2003 Ball
2003/0208888 A1 11/2003 Fearing et al.
2004/0093040 A1 5/2004 Boylston et al.
2004/0121291 A1 6/2004 Knapp et al.
2004/0158157 A1 8/2004 Jensen et al.
2004/0165742 A1 8/2004 Shennib et al.
2004/0166495 A1 8/2004 Greinwald, Jr. et al.
2004/0167377 A1 8/2004 Schafer et al.
2004/0190734 A1 9/2004 Kates
2004/0202339 A1 10/2004 O'Brien, Jr. et al.
2004/0202340 A1 10/2004 Armstrong et al.
2004/0208333 A1 10/2004 Cheung et al.
2004/0234089 A1 11/2004 Rembrand et al.
2004/0234092 A1 11/2004 Wada et al.
2004/0236416 A1 11/2004 Falotico
2004/0240691 A1 12/2004 Grafenberg
2005/0018859 A1 1/2005 Buchholz
2005/0020873 A1 1/2005 Berrang et al.
2005/0036639 A1 2/2005 Bachler et al.
2005/0038498 A1 2/2005 Dubrow et al.
2005/0088435 A1 4/2005 Geng
2005/0101830 A1 5/2005 Easter et al.
2005/0111683 A1 5/2005 Chabries et al.
2005/0117765 A1 6/2005 Meyer et al.
2005/0190939 A1 9/2005 Fretz
2005/0196005 A1 9/2005 Shennib et al.
2005/0222823 A1 10/2005 Brumback et al.
2005/0226446 A1 10/2005 Luo et al.
2005/0267549 A1 12/2005 Della et al.
2005/0271870 A1 12/2005 Jackson
2005/0288739 A1 12/2005 Hassler, Jr. et al.
2006/0058573 A1 3/2006 Neisz et al.
2006/0062420 A1 3/2006 Araki
2006/0074159 A1 4/2006 Lu et al.
2006/0075175 A1 4/2006 Jensen et al.
2006/0161227 A1 7/2006 Walsh et al.
2006/0161255 A1 7/2006 Zarowski et al.
2006/0177079 A1 8/2006 Baekgaard Jensen et al.
2006/0177082 A1 8/2006 Solomito et al.
2006/0183965 A1 8/2006 Kasic et al.
2006/0231914 A1 10/2006 Carey et al.
2006/0233398 A1 10/2006 Husung
2006/0237126 A1 10/2006 Guffrey et al.
2006/0247735 A1 11/2006 Honert et al.
2006/0256989 A1 11/2006 Olsen et al.
2006/0278245 A1 12/2006 Gan
2007/0030990 A1 2/2007 Fischer
2007/0036377 A1 2/2007 Stirnemann
2007/0076913 A1 4/2007 Schanz
2007/0083078 A1 4/2007 Easter et al.
2007/0100197 A1 5/2007 Perkins et al.
2007/0127748 A1 6/2007 Carlile et al.
2007/0127752 A1 6/2007 Armstrong
2007/0127766 A1 6/2007 Combest
2007/0135870 A1 6/2007 Shanks et al.
2007/0161848 A1 7/2007 Dalton et al.
2007/0191673 A1 8/2007 Ball et al.
2007/0201713 A1 8/2007 Fang et al.
2007/0206825 A1 9/2007 Thomasson
2007/0223755 A1 9/2007 Salvetti et al.
2007/0225776 A1 9/2007 Fritsch et al.
2007/0236704 A1 10/2007 Carr et al.
2007/0250119 A1 10/2007 Tyler et al.
2007/0251082 A1 11/2007 Milojevic et al.
2007/0258507 A1 11/2007 Lee et al.
2007/0286429 A1 12/2007 Grafenberg et al.
2008/0021518 A1 1/2008 Hochmair et al.
2008/0051623 A1 2/2008 Schneider et al.
2008/0054509 A1 3/2008 Berman et al.
2008/0063228 A1 3/2008 Mejia et al.
2008/0063231 A1 3/2008 Juneau et al.
2008/0077198 A1 3/2008 Webb et al.
2008/0089292 A1 4/2008 Kitazoe et al.
2008/0107292 A1 5/2008 Kornagel
2008/0123866 A1 5/2008 Rule et al.
2008/0130927 A1 6/2008 Theverapperuma et al.
2008/0188707 A1 8/2008 Bernard et al.
2008/0298600 A1 12/2008 Poe et al.
2008/0300703 A1 12/2008 Widmer et al.
2009/0016553 A1 1/2009 Ho et al.
2009/0023976 A1 1/2009 Cho et al.
2009/0043149 A1 2/2009 Abel et al.
2009/0076581 A1 3/2009 Gibson
2009/0131742 A1 5/2009 Cho et al.
2009/0141919 A1 6/2009 Spitaels et al.
2009/0149697 A1 6/2009 Steinhardt et al.
2009/0157143 A1 6/2009 Edler et al.
2009/0175474 A1 7/2009 Salvetti et al.
2009/0246627 A1 10/2009 Park
2009/0253951 A1 10/2009 Ball et al.
2009/0262966 A1 10/2009 Vestergaard et al.
2009/0281367 A1 11/2009 Cho et al.
2009/0310805 A1 12/2009 Petroff
2009/0316922 A1 12/2009 Merks et al.
2010/0036488 A1 2/2010 De Juan, Jr. et al.
2010/0085176 A1 4/2010 Flick
2010/0103404 A1 4/2010 Remke et al.
2010/0114190 A1 5/2010 Bendett et al.
2010/0145135 A1 6/2010 Ball et al.
2010/0171369 A1 7/2010 Baarman et al.
2010/0172507 A1 7/2010 Merks
2010/0177918 A1 7/2010 Keady et al.
2010/0222639 A1 9/2010 Purcell et al.
2010/0260364 A1 10/2010 Merks
2010/0272299 A1 10/2010 Van Schuylenbergh et al.
2010/0290653 A1 11/2010 Wiggins et al.
2010/0322452 A1* 12/2010 Ladabaum ..... H04R 25/656
381/375
2011/0062793 A1 3/2011 Azancot et al.
2011/0069852 A1 3/2011 Arndt et al.
2011/0084654 A1 4/2011 Julstrom et al.
2011/0112462 A1 5/2011 Parker et al.
2011/0116666 A1 5/2011 Dittberner et al.
2011/0125222 A1 5/2011 Perkins et al.
2011/0130622 A1 6/2011 Ilberg et al.
2011/0144414 A1 6/2011 Spearman et al.
2011/0164771 A1 7/2011 Jensen et al.
2011/0196460 A1 8/2011 Weiss
2011/0221391 A1 9/2011 Won et al.
2011/0249845 A1 10/2011 Kates
2011/0249847 A1 10/2011 Salvetti et al.
2011/0257290 A1 10/2011 Zeller et al.
2011/0258839 A1 10/2011 Probst
2011/0271965 A1 11/2011 Parkins et al.
2012/0008807 A1 1/2012 Gran
2012/0038881 A1 2/2012 Amirparviz et al.
2012/0039493 A1 2/2012 Rucker et al.
2012/0092461 A1 4/2012 Fisker et al.
2012/0114157 A1 5/2012 Arndt et al.
2012/0140967 A1 6/2012 Aubert et al.
2012/0217087 A1 8/2012 Ambrose et al.
2012/0236524 A1 9/2012 Pugh et al.
2012/0263339 A1 10/2012 Funahashi
2013/0004004 A1 1/2013 Zhao et al.
2013/0034258 A1 2/2013 Lin
2013/0083938 A1 4/2013 Bakalos et al.
2013/0089227 A1 4/2013 Kates
2013/0195300 A1 8/2013 Larsen et al.
2013/0230204 A1 9/2013 Monahan et al.
2013/0303835 A1 11/2013 Koskowich
2013/0308782 A1 11/2013 Dittberner et al.

(56) References Cited

U.S. PATENT DOCUMENTS

| | | | |
|---|---|---|---|
| 2013/0308807 | A1 | 11/2013 | Burns |
| 2013/0343584 | A1 | 12/2013 | Bennett et al. |
| 2013/0343585 | A1 | 12/2013 | Bennett et al. |
| 2013/0343587 | A1 | 12/2013 | Naylor et al. |
| 2014/0084698 | A1 | 3/2014 | Asanuma et al. |
| 2014/0107423 | A1 | 4/2014 | Yaacobi |
| 2014/0153761 | A1 | 6/2014 | Shennib et al. |
| 2014/0169603 | A1 | 6/2014 | Sacha et al. |
| 2014/0177863 | A1 | 6/2014 | Parkins |
| 2014/0194891 | A1 | 7/2014 | Shahoian |
| 2014/0254856 | A1 | 9/2014 | Blick et al. |
| 2014/0286514 | A1 | 9/2014 | Pluvinage et al. |
| 2014/0288356 | A1 | 9/2014 | Van Vlem |
| 2014/0288358 | A1 | 9/2014 | Puria et al. |
| 2014/0296620 | A1 | 10/2014 | Puria et al. |
| 2014/0321657 | A1 | 10/2014 | Stirnemann |
| 2014/0379874 | A1 | 12/2014 | Starr et al. |
| 2015/0021568 | A1 | 1/2015 | Gong et al. |
| 2015/0049889 | A1 | 2/2015 | Bern |
| 2015/0117689 | A1 | 4/2015 | Bergs et al. |
| 2015/0124985 | A1 | 5/2015 | Kim et al. |
| 2015/0201269 | A1 | 7/2015 | Dahl |
| 2015/0222978 | A1 | 8/2015 | Murozaki |
| 2015/0245131 | A1 | 8/2015 | Facteau et al. |
| 2015/0358743 | A1 | 12/2015 | Killion |
| 2016/0008176 | A1 | 1/2016 | Goldstein |
| 2016/0064814 | A1 | 3/2016 | Jang et al. |
| 2016/0087687 | A1 | 3/2016 | Kesler et al. |
| 2016/0094043 | A1 | 3/2016 | Hao et al. |
| 2016/0277854 | A1 | 9/2016 | Puria et al. |
| 2016/0309265 | A1 | 10/2016 | Pluvinage et al. |
| 2016/0309266 | A1 | 10/2016 | Olsen et al. |
| 2016/0330555 | A1 | 11/2016 | Vonlanthen et al. |
| 2017/0040012 | A1 | 2/2017 | Goldstein |
| 2017/0095202 | A1 | 4/2017 | Facteau et al. |
| 2017/0180888 | A1 | 6/2017 | Andersson et al. |
| 2017/0195806 | A1 | 7/2017 | Atamaniuk et al. |
| 2017/0257710 | A1 | 9/2017 | Parker |
| 2018/0077503 | A1 | 3/2018 | Shaquer et al. |
| 2018/0077504 | A1 | 3/2018 | Shaquer et al. |
| 2018/0213331 | A1 | 7/2018 | Rucker et al. |
| 2018/0262846 | A1 | 9/2018 | Perkins et al. |
| 2018/0317026 | A1 | 11/2018 | Puria |
| 2018/0376255 | A1 | 12/2018 | Parker |
| 2019/0158961 | A1 | 5/2019 | Puria et al. |
| 2019/0166438 | A1 | 5/2019 | Perkins et al. |
| 2019/0230449 | A1 | 7/2019 | Puria |
| 2019/0239005 | A1 | 8/2019 | Sandhu et al. |
| 2019/0253811 | A1 | 8/2019 | Unno et al. |
| 2019/0253815 | A1 | 8/2019 | Atamaniuk et al. |
| 2019/0269336 | A1 | 9/2019 | Perkins et al. |
| 2020/0037082 | A1 | 1/2020 | Perkins et al. |
| 2020/0068323 | A1 | 2/2020 | Perkins et al. |
| 2020/0084551 | A1 | 3/2020 | Puria et al. |
| 2020/0084553 | A1 | 3/2020 | Perkins et al. |
| 2020/0092662 | A1 | 3/2020 | Wenzel |
| 2020/0092664 | A1 | 3/2020 | Freed et al. |
| 2020/0128338 | A1 | 4/2020 | Shaquer et al. |
| 2020/0186941 | A1 | 6/2020 | Olsen et al. |
| 2020/0186942 | A1 | 6/2020 | Flaherty et al. |
| 2020/0304927 | A1 | 9/2020 | Shaquer et al. |
| 2020/0336843 | A1 | 10/2020 | Lee et al. |
| 2020/0374639 | A1 | 11/2020 | Rucker et al. |
| 2021/0029451 | A1 | 1/2021 | Fitz et al. |
| 2021/0029474 | A1 | 1/2021 | Larkin et al. |
| 2021/0186343 | A1 | 6/2021 | Perkins et al. |
| 2021/0266686 | A1 | 8/2021 | Puria et al. |
| 2021/0274293 | A1 | 9/2021 | Perkins et al. |
| 2021/0289301 | A1 | 9/2021 | Atamaniuk et al. |
| 2021/0306777 | A1 | 9/2021 | Rucker et al. |
| 2021/0314712 | A1 | 10/2021 | Shaquer et al. |
| 2021/0392449 | A1 | 12/2021 | Flaherty et al. |
| 2021/0400405 | A1 | 12/2021 | Perkins et al. |
| 2022/0007114 | A1 | 1/2022 | Perkins et al. |
| 2022/0007115 | A1 | 1/2022 | Perkins et al. |
| 2022/0007118 | A1 | 1/2022 | Rucker et al. |
| 2022/0007120 | A1 | 1/2022 | Olsen et al. |
| 2022/0046366 | A1 | 2/2022 | Larkin et al. |
| 2022/0086572 | A1 | 3/2022 | Flaherty et al. |
| 2022/0150650 | A1 | 5/2022 | Rucker |

FOREIGN PATENT DOCUMENTS

| | | | |
|---|---|---|---|
| CN | 1176731 | A | 3/1998 |
| CN | 101459868 | A | 6/2009 |
| CN | 101489171 | A | 7/2009 |
| CN | 102301747 | A | 12/2011 |
| CN | 105491496 | A | 4/2016 |
| DE | 2044870 | A1 | 3/1972 |
| DE | 3243850 | A1 | 5/1984 |
| DE | 3508830 | A1 | 9/1986 |
| DE | 102013114771 | A1 | 6/2015 |
| EP | 0092822 | A2 | 11/1983 |
| EP | 0242038 | A2 | 10/1987 |
| EP | 0291325 | A2 | 11/1988 |
| EP | 0296092 | A2 | 12/1988 |
| EP | 0242038 | A3 | 5/1989 |
| EP | 0296092 | A3 | 8/1989 |
| EP | 0352954 | A2 | 1/1990 |
| EP | 0291325 | A3 | 6/1990 |
| EP | 0352954 | A3 | 8/1991 |
| EP | 1035753 | A1 | 9/2000 |
| EP | 1435757 | A1 | 7/2004 |
| EP | 1845919 | A1 | 10/2007 |
| EP | 1955407 | A1 | 8/2008 |
| EP | 1845919 | B1 | 9/2010 |
| EP | 2272520 | A1 | 1/2011 |
| EP | 2301262 | A1 | 3/2011 |
| EP | 2752030 | A1 | 7/2014 |
| EP | 3101519 | A1 | 12/2016 |
| EP | 2425502 | B1 | 1/2017 |
| EP | 2907294 | B1 | 5/2017 |
| EP | 3183814 | A1 | 6/2017 |
| EP | 3094067 | B1 | 10/2017 |
| EP | 3006079 | B1 | 3/2019 |
| FR | 2455820 | A1 | 11/1980 |
| GB | 2085694 | A | 4/1982 |
| JP | S60154800 | A | 8/1985 |
| JP | S621726 | B2 | 1/1987 |
| JP | S6443252 | A | 2/1989 |
| JP | H09327098 | A | 12/1997 |
| JP | 2000504913 | A | 4/2000 |
| JP | 2004187953 | A | 7/2004 |
| JP | 2004193908 | A | 7/2004 |
| JP | 2005516505 | A | 6/2005 |
| JP | 2006060833 | A | 3/2006 |
| KR | 100624445 | B1 | 9/2006 |
| WO | WO-9209181 | A1 | 5/1992 |
| WO | WO-9501678 | A1 | 1/1995 |
| WO | WO-9621334 | A1 | 7/1996 |
| WO | WO-9736457 | A1 | 10/1997 |
| WO | WO-9745074 | A1 | 12/1997 |
| WO | WO-9806236 | A1 | 2/1998 |
| WO | WO-9903146 | A1 | 1/1999 |
| WO | WO-9915111 | A1 | 4/1999 |
| WO | WO-0022875 | A2 | 4/2000 |
| WO | WO-0022875 | A3 | 7/2000 |
| WO | WO-0150815 | A1 | 7/2001 |
| WO | WO-0158206 | A2 | 8/2001 |
| WO | WO-0176059 | A2 | 10/2001 |
| WO | WO-0158206 | A3 | 2/2002 |
| WO | WO-0239874 | A2 | 5/2002 |
| WO | WO-0239874 | A3 | 2/2003 |
| WO | WO-03030772 | A2 | 4/2003 |
| WO | WO-03063542 | A2 | 7/2003 |
| WO | WO-03063542 | A3 | 1/2004 |
| WO | WO-2004010733 | A1 | 1/2004 |
| WO | WO-2005015952 | A1 | 2/2005 |
| WO | WO-2005107320 | A1 | 11/2005 |
| WO | WO-2006014915 | A2 | 2/2006 |
| WO | WO-2006037156 | A1 | 4/2006 |
| WO | WO-2006039146 | A2 | 4/2006 |
| WO | WO-2006042298 | A2 | 4/2006 |
| WO | WO-2006071210 | A1 | 7/2006 |

(56) References Cited

FOREIGN PATENT DOCUMENTS

| | | | |
|---|---|---|---|
| WO | WO-2006075169 | A1 | 7/2006 |
| WO | WO-2006075175 | A1 | 7/2006 |
| WO | WO-2006118819 | A2 | 11/2006 |
| WO | WO-2006042298 | A3 | 12/2006 |
| WO | WO-2007023164 | A1 | 3/2007 |
| WO | WO-2009046329 | A1 | 4/2009 |
| WO | WO-2009047370 | A2 | 4/2009 |
| WO | WO-2009049320 | A1 | 4/2009 |
| WO | WO-2009056167 | A1 | 5/2009 |
| WO | WO-2009062142 | A1 | 5/2009 |
| WO | WO-2009047370 | A3 | 7/2009 |
| WO | WO-2009125903 | A1 | 10/2009 |
| WO | WO-2009145842 | A2 | 12/2009 |
| WO | WO-2009146151 | A2 | 12/2009 |
| WO | WO-2009155358 | A1 | 12/2009 |
| WO | WO-2009155361 | A1 | 12/2009 |
| WO | WO-2009155385 | A1 | 12/2009 |
| WO | WO-2010033932 | A1 | 3/2010 |
| WO | WO-2010033933 | A1 | 3/2010 |
| WO | WO-2010077781 | A2 | 7/2010 |
| WO | WO-2010147935 | A1 | 12/2010 |
| WO | WO-2010148345 | A2 | 12/2010 |
| WO | WO-2011005500 | A2 | 1/2011 |
| WO | WO-2012088187 | A2 | 6/2012 |
| WO | WO-2012149970 | A1 | 11/2012 |
| WO | WO-2013016336 | A2 | 1/2013 |
| WO | WO-2016011044 | A1 | 1/2016 |
| WO | WO-2016045709 | A1 | 3/2016 |
| WO | WO-2016146487 | A1 | 9/2016 |
| WO | WO-2017045700 | A1 | 3/2017 |
| WO | WO-2017059218 | A1 | 4/2017 |
| WO | WO-2017059240 | A1 | 4/2017 |
| WO | WO-2017116791 | A1 | 7/2017 |
| WO | WO-2017116865 | A1 | 7/2017 |
| WO | WO-2018048794 | A1 | 3/2018 |
| WO | WO-2018081121 | A1 | 5/2018 |
| WO | WO-2018093733 | A1 | 5/2018 |
| WO | WO-2019055308 | A1 | 3/2019 |
| WO | WO-2019173470 | A1 | 9/2019 |
| WO | WO-2019199680 | A1 | 10/2019 |
| WO | WO-2019199683 | A1 | 10/2019 |
| WO | WO-2020028082 | A1 | 2/2020 |
| WO | WO-2020028083 | A1 | 2/2020 |
| WO | WO-2020028084 | A1 | 2/2020 |
| WO | WO-2020028085 | A1 | 2/2020 |
| WO | WO-2020028086 | A1 | 2/2020 |
| WO | WO-2020028087 | A1 | 2/2020 |
| WO | WO-2020028088 | A1 | 2/2020 |
| WO | WO-2020176086 | A1 | 9/2020 |
| WO | WO-2021003087 | A1 | 1/2021 |

OTHER PUBLICATIONS

Atasoy [Paper] Opto-acoustic Imaging. for BYM504E Biomedical Imaging Systems class at ITU, downloaded from the Internet www2.itu.edu.td—cilesiz/courses/BYM504- 2005-OA504041413.pdf, 14 pages.

Athanassiou, et al. Laser controlled photomechanical actuation of photochromic polymers Microsystems. Rev. Adv. Mater. Sci. 2003; 5:245-251.

Autumn, et al. Dynamics of geckos running vertically, The Journal of Experimental Biology 209, 260-272, (2006).

Autumn, et al., Evidence for van der Waals adhesion in gecko setae, www.pnas.orgycgiydoiy10.1073ypnas.192252799 (2002).

Ayatollahi, et al. Design and Modeling of Micromachined Condenser MEMS Loudspeaker using Permanent Magnet Neodymium-Iron-Boron (Nd—Fe—B). IEEE International Conference on Semiconductor Electronics, 2006. ICSE '06, Oct. 29, 2006-Dec. 1, 2006; 160-166.

Baer, et al. Effects of Low Pass Filtering on the Intelligibility of Speech in Noise for People With and Without Dead Regions at High Frequencies. J. Acost. Soc. Am 112 (3), pt. 1, (Sep. 2002), pp. 1133-1144.

Best, et al. The influence of high frequencies on speech localization. Abstract 981 (Feb. 24, 2003) from www.aro.org/abstracts/abstracts.html.

Birch, et al. Microengineered systems for the hearing impaired. IEE Colloquium on Medical Applications of Microengineering, Jan. 31, 1996; pp. 2/1-2/5.

Boedts. Tympanic epithelial migration, Clinical Otolaryngology 1978, 3, 249-253.

Burkhard, et al. Anthropometric Manikin for Acoustic Research. J. Acoust. Soc. Am., vol. 58, No. 1, (Jul. 1975), pp. 214-222.

Camacho-Lopez, et al. Fast Liquid Crystal Elastomer Swims Into the Dark, Electronic Liquid Crystal Communications. Nov. 26, 2003; 9 pages total.

Carlile, et al. Frequency bandwidth and multi-talker environments. Audio Engineering Society Convention 120. Audio Engineering Society, May 20-23, 2006. Paris, France. 118: 8 pages.

Carlile, et al. Spatialisation of talkers and the segregation of concurrent speech. Abstract 1264 (Feb. 24, 2004) from www.aro.org/abstracts/abstracts.html.

Cheng, et al. A Silicon Microspeaker for Hearing Instruments. Journal of Micromechanics and Microengineering 2004; 14(7):859-866.

Co-pending U.S. Appl. No. 17/066,341, inventors Larkin; Brendan et al., filed Oct. 8, 2020.

Co-pending U.S. Appl. No. 17/066,345, inventors Fitz; Kelly et al., filed Oct. 8, 2020.

Dictionary.com's (via American Heritage Medical Dictionary) online dictionary definition of 'percutaneous'. Accessed on Jun. 3, 2013. 2 pages.

Merriam-Webster's online dictionary definition of 'percutaneous'. Accessed on Jun. 3, 2013. 3 pages.

Datskos, et al. Photoinduced and thermal stress in silicon microcantilevers. Applied Physics Letters. Oct. 19, 1998; 73(16):2319-2321.

Decraemer, et al. A method for determining three-dimensional vibration in the ear. Hearing Res., 77:19-37 (1994).

Dundas et al. The Earlens Light-Driven Hearing Aid: Top 10 questions and answers. Hearing Review. 2018;25(2):36-39.

Ear. Downloaded from the Internet. Accessed Jun. 17, 2008. 4 pages. URL: http://wwwmgs.bionet.nsc.ru/mgs/gnw/trrd/thesaurus/Se/ear.html.

Edinger, J.R. High-Quality Audio Amplifier With Automatic Bias Control. Audio Engineering; Jun. 1947; pp. 7-9.

Fay. Cat eardrum mechanics. Ph.D. thesis. Disseration submitted to Department of Aeronautics and Astronautics. Standford University. May 2001; 210 pages total.

Fay, et al. Cat eardrum response mechanics. Mechanics and Computation Division. Department of Mechanical Engineering. Standford University. 2002; 10 pages total.

Fay, et al. Preliminary evaluation of a light-based contact hearing device for the hearing impaired. Otol Neurotol. Jul. 2013;34(5):912-21. doi: 10.1097/MAO.0b013e31827de4b1.

Fay, et al. The discordant eardrum, PNAS, Dec. 26, 2006, vol. 103, No. 52, p. 19743-19748.

Fletcher. Effects of Distortion on the Individual Speech Sounds. Chapter 18, ASA Edition of Speech and Hearing in Communication, Acoust Soc.of Am. (republished in 1995) pp. 415-423.

Freyman, et al. Spatial Release from Informational Masking in Speech Recognition. J. Acost. Soc. Am., vol. 109, No. 5, pt. 1, (May 2001); 2112-2122.

Freyman, et al. The Role of Perceived Spatial Separation in the Unmasking of Speech. J. Acoust. Soc. Am., vol. 106, No. 6, (Dec. 1999); 3578-3588.

Fritsch, et al. EarLens transducer behavior in high-field strength MRI scanners. Otolaryngol Head Neck Surg. Mar. 2009;140(3):426-8. doi: 10.1016/j.otohns.2008.10.016.

Galbraith et al. A wide-band efficient inductive transdermal power and data link with coupling insensitive gain IEEE Trans Biomed Eng. Apr. 1987;34(4):265-75.

Gantz, et al. Broad Spectrum Amplification with a Light Driven Hearing System. Combined Otolaryngology Spring Meetings, 2016 (Chicago).

(56) References Cited

OTHER PUBLICATIONS

Gantz, et al. Light Driven Hearing System: A Multi-Center Clinical Study. Association for Research in Otolaryngology Annual Meeting, 2016 (San Diego).
Gantz, et al. Light-Driven Contact Hearing Aid for Broad Spectrum Amplification: Safety and Effectiveness Pivotal Study. Otology & Neurotology Journal, 2016 (in review).
Gantz, et al. Light-Driven Contact Hearing Aid for Broad-Spectrum Amplification: Safety and Effectiveness Pivotal Study. Otology & Neurotology. Copyright 2016. 7 pages.
Ge, et al., Carbon nanotube-based synthetic gecko tapes, p. 10792-10795, PNAS, Jun. 26, 2007, vol. 104, No. 26.
Gennum. GA3280 Preliminary Data Sheet: Voyageur TD Open Platform DSP System for Ultra Low Power Audio Processing. Oct. 2006; 17 pages. Downloaded from the Internet: http://www.sounddesigntechnologies.com/products/pdf/37601DOC.pdf.
Gobin, et al. Comments on the physical basis of the active materials concept. Proc. SPIE 2003; 4512:84-92.
Gorb, et al. Structural Design and Biomechanics of Friction-Based Releasable Attachment Devices in Insects. Integr Comp Biol. Dec. 2002. 42(6):1127-1139. doi: 10.1093/icb/42.6.1127.
Hakansson, et al. Percutaneous vs. transcutaneous transducers for hearing by direct bone conduction (Abstract). Otolaryngol Head Neck Surg. Apr. 1990;102(4):339-44.
Hato, et al. Three-dimensional stapes footplate motion in human temporal bones. Audiol. Neurootol., 8:140-152 (Jan. 30, 2003).
Headphones. Wikipedia Entry. Downloaded from the Internet. Accessed Oct. 27, 2008. 7 pages. URL: http://en.wikipedia.org/wiki/Headphones>.
Hofman, et al. Relearning Sound Localization With New Ears. Nature Neuroscience, vol. 1, No. 5, (Sep. 1998); 417-421.
Izzo, et al. Laser Stimulation of Auditory Neurons: Effect of Shorter Pulse Duration and Penetration Depth. Biophys J. Apr. 15, 2008;94(8):3159-3166.
Izzo, et al. Laser Stimulation of the Auditory Nerve. Lasers Surg Med. Sep. 2006;38(8):745-753.
Izzo, et al. Selectivity of Neural Stimulation in the Auditory System: A Comparison of Optic and Electric Stimuli. J Biomed Opt. Mar.-Apr. 2007;12(2):021008.
Jackson, et al. Multiphoton and Transmission Electron Microscopy of Collagen in Ex Vivo Tympanic Membranes. Ninth Annual Symposium on Biomedical Computation at Stanford (BCATS). BCATS 2008 Abstract Book. Poster 18:56. Oct. 2008. URL: http://www.stanford.edu/~puria1/BCATS08.html.
Jian, et al. A 0.6 V, 1.66 mW energy harvester and audio driver for tympanic membrane transducer with wirelessly optical signal and power transfer. InCircuits and Systems (ISCAS), 2014 IEEE International Symposium on Jun. 1, 2014. 874-7. IEEE.
Jin, et al. Speech Localization. J. Audio Eng. Soc. convention paper, presented at the AES 112th Convention, Munich, Germany, May 10-13, 2002, 13 pages total.
Khaleghi, et al. Attenuating the ear canal feedback pressure of a laser-driven hearing aid. J Acoust Soc Am. Mar. 2017;141(3):1683.
Khaleghi, et al. Attenuating the feedback pressure of a light-activated hearing device to allows microphone placement at the ear canal entrance. IHCON 2016, International Hearing Aid Research Conference, Tahoe City, CA, Aug. 2016.
Khaleghi, et al. Characterization of Ear-Canal Feedback Pressure due to Umbo-Drive Forces: Finite-Element vs. Circuit Models. ARO Midwinter Meeting 2016, (San Diego).
Khaleghi, et al. Mechano-Electro-Magnetic Finite Element Model of a Balanced Armature Transducer for a Contact Hearing Aid. Proc. MoH 2017, Mechanics of Hearing workshop, Brock University, Jun. 2017.
Khaleghi, et al. Multiphysics Finite Element Model of a Balanced Armature Transducer used in a Contact Hearing Device. ARO 2017, 40th ARO MidWinter Meeting, Baltimore, MD, Feb. 2017.
Kiessling, et al. Occlusion Effect of Earmolds with Different Venting Systems. J Am Acad Audiol. Apr. 2005;16(4):237-49.
Killion, et al. The case of the missing dots: AI and SNR loss. The Hearing Journal, 1998. 51(5), 32-47.
Killion. Myths About Hearing in Noise and Directional Microphones. The Hearing Review. Feb. 2004; 11(2):14, 16, 18, 19, 72 & 73.
Killion. SNR loss: I can hear what people say but I can't understand them. The Hearing Review, 1997; 4(12):8-14.
Knight, D. Diode detectors for RF measurement. Paper. Jan. 1, 2016. [Retrieved from Jan. 2016 online] (retrieved Feb. 11, 2020) abstract, p. 1; section 1, p. 6; section 1.3, p. 9; section 3 voltage-double rectifier, p. 21; section 5, p. 27. URL: g3ynh.info/circuits/Diode_det.pdf.
Lee, et al. A Novel Opto-Electromagnetic Actuator Coupled to the tympanic Membrane. J Biomech. Dec. 5, 2008;41(16):3515-8. Epub Nov. 7, 2008.
Lee, et al. The optimal magnetic force for a novel actuator coupled to the tympanic membrane: a finite element analysis. Biomedical engineering: applications, basis and communications. 2007; 19(3):171-177.
Levy, et al. Characterization of the available feedback gain margin at two device microphone locations, in the fossa triangularis and Behind the Ear, for the light-based contact hearing device. Acoustical Society of America (ASA) meeting, 2013 (San Francisco).
Levy, et al. Extended High-Frequency Bandwidth Improves Speech Reception in the Presence of Spatially Separated Masking Speech. Ear Hear. Sep.-Oct. 2015;36(5):e214-24. doi: 10.1097/AUD.0000000000000161.
Levy et al. Light-driven contact hearing aid: a removable direct-drive hearing device option for mild to severe sensorineural hearing impairment. Conference on Implantable Auditory Prostheses, Tahoe City, CA, Jul. 2017. 4 pages.
Lezal. Chalcogenide glasses—survey and progress. Journal of Optoelectronics and Advanced Materials. Mar. 2003; 5(1):23-34.
Mah. Fundamentals of photovoltaic materials. National Solar Power Research Institute. Dec. 21, 1998, 3-9.
Makino, et al. Epithelial migration in the healing process of tympanic membrane perforations. Eur Arch Otorhinolaryngol. 1990; 247: 352-355.
Makino, et al., Epithelial migration on the tympanic membrane and external canal, Arch Otorhinolaryngol (1986) 243:39-42.
Markoff. Intuition + Money: An Aha Moment. New York Times Oct. 11, 2008, p. BU4, 3 pages total.
Martin, et al. Utility of Monaural Spectral Cues is Enhanced in the Presence of Cues to Sound-Source Lateral Angle. JARO. 2004; 5:80-89.
McElveen et al. Overcoming High-Frequency Limitations of Air Conduction Hearing Devices Using a Light-Driven Contact Hearing Aid. Poster presentation at The Triological Society, 120th Annual Meeting at COSM, Apr. 28, 2017; San Diego, CA.
Michaels, et al., Auditory epithelial migration on the human tympanic membrane: II. The existence of two discrete migratory pathways and their embryologic correlates. Am J Anat. Nov. 1990. 189(3):189-200. DOI: 10.1002/aja.1001890302.
Moore, et al. Perceived naturalness of spectrally distorted speech and music. J Acoust Soc Am. Jul. 2003;114(1):408-19.
Moore, et al. Spectro-temporal characteristics of speech at high frequencies, and the potential for restoration of audibility to people with mild-to-moderate hearing loss. Ear Hear. Dec. 2008;29(6):907-22. doi: 10.1097/AUD.0b013e31818246f6.
Moore. Loudness perception and intensity resolution. Cochlear Hearing Loss, Chapter 4, pp. 90-115, Whurr Publishers Ltd., London (1998).
Murphy, et al. Adhesion and anisotropic friction enhancements of angled heterogeneous micro-fiber arrays with spherical and spatula tips. Journal of Adhesion Science and Technology. vol. 21. No. 12-13. Aug. 2007. pp. 1281-1296. DOI: 10.1163/156856107782328380.
Murugasu, et al. Malleus-to-footplate versus malleus-to-stapes-head ossicular reconstruction prostheses: temporal bone pressure gain measurements and clinical audiological data. Otol Neurotol. Jul. 2005;26(4):572-82. DOI: 10.1097/01.mao.0000178151.44505.1b.
Musicant, et al. Direction-dependent spectral properties of cat external ear: new data and cross-species comparisons. J Acoust Soc Am. Feb. 1990. 87(2):757-781. DOI: 10.1121/1.399545.

(56) References Cited

OTHER PUBLICATIONS

National Semiconductor. LM4673 Boomer: Filterless, 2.65W, Mono, Class D Audio Power Amplifier. Nov. 1, 2007. 24 pages. [Data Sheet] downloaded from the Internet: URL: http://www.national.com/ds/LM/LM4673.pdf.
Nishihara, et al. Effect of changes in mass on middle ear function. Otolaryngol Head Neck Surg. Nov. 1993;109(5):889-910.
O'Connor, et al. Middle ear Cavity and Ear Canal Pressure-Driven Stapes Velocity Responses in Human Cadaveric Temporal Bones. J Acoust Soc Am. Sep. 2006;120(3):1517-28.
Park, et al. Design and analysis of a microelectromagnetic vibration transducer used as an implantable middle ear hearing aid. J. Micromech. Microeng. vol. 12 (2002), pp. 505-511.
Perkins, et al. Light-based Contact Hearing Device: Characterization of available Feedback Gain Margin at two device microphone locations. Presented at AAO-HNSF Annual Meeting, 2013 (Vancouver).
Perkins, et al. The EarLens Photonic Transducer: Extended bandwidth. Presented at AAO-HNSF Annual Meeting, 2011 (San Francisco).
Perkins, et al. The EarLens System: New sound transduction methods. Hear Res. Feb. 2, 2010; 10 pages total.
Perkins, R. Earlens tympanic contact transducer: a new method of sound transduction to the human ear. Otolaryngol Head Neck Surg. Jun. 1996;114(6):720-8.
Poosanaas, et al. Influence of sample thickness on the performance of photostrictive ceramics, J. App. Phys. Aug. 1, 1998; 84(3):1508-1512.
Puria et al. A gear in the middle ear. ARO Denver CO, 2007b.
Puria, et al. Cues above 4 kilohertz can improve spatially separated speech recognition. The Journal of the Acoustical Society of America, 2011, 129, 2384.
Puria, et al. Extending bandwidth above 4 kHz improves speech understanding in the presence of masking speech. Association for Research in Otolaryngology Annual Meeting, 2012 (San Diego).
Puria, et al. Extending bandwidth provides the brain what it needs to improve hearing in noise. First international conference on cognitive hearing science for communication, 2011 (Linkoping, Sweden).
Puria, et al. Hearing Restoration: Improved Multi-talker Speech Understanding. 5th International Symposium on Middle Ear Mechanics in Research and Otology (MEMRO), Jun. 2009 (Stanford University).
Puria, et al. Imaging, Physiology and Biomechanics of the middle ear: Towards understating the functional consequences of anatomy. Stanford Mechanics and Computation Symposium, 2005, ed Fong J.
Puria, et al. Malleus-to-footplate ossicular reconstruction prosthesis positioning: cochleovestibular pressure optimization. Otol Nerotol. May 2005; 26(3):368-379. DOI: 10.1097/01.mao.0000169788.07460.4a.
Puria, et al. Measurements and model of the cat middle ear: Evidence of tympanic membrane acoustic delay. J. Acoust. Soc. Am., 104(6):3463-3481 (Dec. 1998).
Puria, et al., Mechano-Acoustical Transformations in A. Basbaum et al., eds., The Senses: A Comprehensive Reference, v3, p. 165-201, Academic Press (2008).
Puria, et al. Middle Ear Morphometry From Cadaveric Temporal Bone MicroCT Imaging. Proceedings of the 4th International Symposium, Zurich, Switzerland, Jul. 27-30, 2006, Middle Ear Mechanics in Research and Otology, pp. 260-269.
Puria, et al. Sound-Pressure Measurements in the Cochlear Vestibule of Human-Cadaver Ears. Journal of the Acoustical Society of America. 1997; 101 (5-1): 2754-2770.
Puria, et al. Temporal-Bone Measurements of the Maximum Equivalent Pressure Output and Maximum Stable Gain of a Light-Driven Hearing System That Mechanically Stimulates the Umbo. Otol Neurotol. Feb. 2016;37(2):160-6. doi: 10.1097/MAO.0000000000000941.
Puria, et al. The EarLens Photonic Hearing Aid. Association for Research in Otolaryngology Annual Meeting, 2012 (San Diego).
Puria, et al. The Effects of bandwidth and microphone location on understanding of masked speech by normal-hearing and hearing-impaired listeners. International Conference for Hearing Aid Research (IHCON) meeting, 2012 (Tahoe City).
Puria, et al. Tympanic-membrane and malleus-incus-complex co-adaptations for high-frequency hearing in mammals. Hear Res. May 2010;263(1-2):183-90. doi: 10.1016/j.heares.2009.10.013. Epub Oct. 28, 2009.
Puria. Measurements of human middle ear forward and reverse acoustics: implications for otoacoustic emissions. J Acoust Soc Am. May 2003;113(5):2773-89.
Puria, S. Middle Ear Hearing Devices. Chapter 10. Part of the series Springer Handbook of Auditory Research pp. 273-308. Date: Feb. 9, 2013.
Qu, et al. Carbon nanotube arrays with strong shear binding-on and easy normal lifting-off. Science. Oct. 10, 2008. 322(5899):238-342. doi: 10.1126/science.1159503.
Robles, et al. Mechanics of the mammalian cochlea. Physiol Rev. Jul. 2001;81(3):1305-52.
Roush. SiOnyx Brings "Black Silicon" into the Light; Material Could Upend Solar, Imaging Industries. Xconomy, Oct. 12, 2008, retrieved from the Internet: www.xconomy.com/boston/2008/10/12/sionyx-brings-black-silicon-into-the-light¬material-could-upend-solar-imaging-industries 4 pages total.
Rubinstein. How cochlear implants encode speech. Curr Opin Otolaryngol Head Neck Surg. Oct. 2004. 12(5):444-448. DOI: 10.1097/01.moo.0000134452.24819.c0.
School of Physics Sydney, Australia. Acoustic Compliance, Inertance and Impedance. 1-6. (2018). http://www.animations.physics.unsw.edu.au/jw/compliance-inertance-impedance.htm.
Sekaric, et al. Nanomechanical resonant structures as tunable passive modulators. Applied Physics Letters. May 2002. 80(19):3617-3619. DOI: 10.1063/1.1479209.
Shaw. Transformation of Sound Pressure Level From the Free Field to the Eardrum in the Horizontal Plane. J. Acoust. Soc. Am., vol. 56, No. 6, (Dec. 1974), 1848-1861.
Shih, et al. Shape and displacement control of beams with various boundary conditions via photostrictive optical actuators. Proc. IMECE. Nov. 2003; 1-10.
Smith. The Scientist and Engineers Guide to Digital Signal Processing. California Technical Publishing. 1997. Chapter 22. pp. 351-372.
Song, et al. The development of a non-surgical direct drive hearing device with a wireless actuator coupled to the tympanic membrane. Applied Acoustics. Dec. 31, 2013;74(12):1511-8.
Sound Design Technologies. Voyager TD Open Platform DSP System for Ultra Low Power Audio Processing—GA3280 Data Sheet. Oct. 2007. 15 pages. Retrieved from the Internet: http://www.sounddes.com/pdf/37601DOC.pdf.
Spolenak, et al. Effects of contact shape on the scaling of biological attachments. Proc. R. Soc. A. 2005; 461:305-319.
Stenfelt, et al. Bone-Conducted Sound: Physiological and Clinical Aspects. Otology & Neurotology, Nov. 2005; 26 (6):1245-1261.
Struck, et al. Comparison of Real-world Bandwidth in Hearing Aids vs Earlens Light-driven Hearing Aid System. The Hearing Review. TechTopic: EarLens. Hearingreview.com. Mar. 14, 2017. pp. 24-28.
Stuchlik, et al. Micro-Nano Actuators Driven by Polarized Light. IEEE Proc. Sci. Meas. Techn. Mar. 2004; 151(2):131-136.
Suski, et al. Optically activated ZnO/SiO2/Si cantilever beams. Sensors and Actuators A: Physical. Sep. 1990. 24(3): 221-225. https://doi.org/10.1016/0924-4247(90)80062-A.
Takagi, et al. Mechanochemical Synthesis of Piezoelectric PLZT Powder. KONA. 2003; 51(21):234-241.
Thakoor, et al. Optical microactuation in piezoceramics. Proc. SPIE. Jul. 1998; 3328:376-391.
Thompson. Tutorial on microphone technologies for directional hearing aids. Hearing Journal. Nov. 2003; 56(11):14-16,18, 20-21.
Tzou, et al. Smart Materials, Precision Sensors/Actuators, Smart Structures, and Structronic Systems. Mechanics of Advanced Materials and Structures. 2004; 11:367-393.

(56) References Cited

OTHER PUBLICATIONS

Uchino, et al. Photostricitve actuators. Ferroelectrics. 2001; 258:147-158.
Vickers, et al. Effects of Low-Pass Filtering on the Intelligibility of Speech in Quiet for People With and Without Dead Regions at High Frequencies. J. Acoust. Soc. Am. Aug. 2001; 110(2):1164-1175.
Vinge. Wireless Energy Transfer by Resonant Inductive Coupling. Master of Science Thesis. Chalmers University of Technology. 1-83 (2015).
Vinikman-Pinhasi, et al. Piezoelectric and Piezooptic Effects in Porous Silicon. Applied Physics Letters, Mar. 2006; 88(11): 111905-1-111905-2. DOI: 10.1063/1.2186395.
Wang, et al. Preliminary Assessment of Remote Photoelectric Excitation of an Actuator for a Hearing Implant. Proceeding of the 2005 IEEE, Engineering in Medicine and Biology 27th nnual Conference, Shanghai, China. Sep. 1-4, 2005; 6233-6234.
Web Books Publishing, "The Ear," accessed online Jan. 22, 2013, available online Nov. 2, 2007 at http://www.web-books.com/eLibrary/Medicine/Physiology/Ear/Ear.htm.
Wiener, et al. On the Sound Pressure Transformation By the Head and Auditory Meatus of the Cat. Acta Otolaryngol. Mar. 1966; 61(3):255-269.
Wightman, et al. Monaural Sound Localization Revisited. J Acoust Soc Am. Feb. 1997;101(2):1050-1063.
Wiki. Sliding Bias Variant 1, Dynamic Hearing (2015).
Wikipedia. Inductive Coupling. 1-2 (Jan. 11, 2018). https://en.wikipedia.org/wiki/Inductive_coupling.
Wikipedia. Pulse-density Coupling. 1-4 (Apr. 6, 2017). https://en.wikipedia.org/wiki/Pulse-density_modulation.
Wikipedia. Resonant Inductive Coupling. 1-11 (Jan. 12, 2018). https://en.wikipedia.org/wiki/Resonant_inductive_coupling#cite_note-13.
Yao, et al. Adhesion and sliding response of a biologically inspired fibrillar surface: experimental observations, J. R. Soc. Interface (2008) 5, 723-733 doi:10.1098/rsif.2007.1225 Published online Oct. 30, 2007.
Yao, et al. Maximum strength for intermolecular adhesion of nanospheres at an optimal size. J R Soc Interface. Nov. 6, 2008;5(28):1363-70. doi: 10.1098/rsif.2008.0066.
Yi, et al. Piezoelectric Microspeaker with Compressive Nitride Diaphragm. The Fifteenth IEEE International Conference on Micro Electro Mechanical Systems, 2002; 260-263.
Yu, et al. Photomechanics: Directed bending of a polymer film by light. Nature. Sep. 11, 2003;425(6954):145. DOI: 10.1038/425145a.
Co-pending U.S. Appl. No. 17/356,217, inventors Imatani; Kyle et al., filed Jun. 23, 2021.
Co-pending U.S. Appl. No. 17/412,850, inventors Flaherty; Bryan et al., filed Aug. 26, 2021.
Folkeard, et al. Detection, Speech Recognition, Loudness, and Preference Outcomes With a Direct Drive Hearing Aid: Effects of Bandwidth. Trends Hear. Jan.-Dec. 2021; 25: 1-17. doi: 10.1177/2331216521999139.
PCT/US2019/020942 International Search Report and Written Opinion dated May 31, 2019.
Co-pending U.S. Appl. No. 17/549,722, inventor Rucker; Paul, filed Dec. 13, 2021.

* cited by examiner

CONTACT HEARING DEVICE AND RETENTION STRUCTURE MATERIALS

CROSS REFERENCE TO RELATED APPLICATIONS

This application is a continuation of PCT Application No. PCT/US2019/020942, filed Mar. 6, 2019; which claims priority to U.S. Provisional Application No. 62/639,796, filed Mar. 7, 2018; the contents of which are incorporated herein by reference in their entirety.

BACKGROUND OF THE INVENTION

Field of the Invention

The present invention relates to the use of select materials in the sulcus and umbo platform of a contact hearing aid device and, more particularly, to the use of materials having specific characteristics which improve the performance of the contact hearing aid devices.

Background

A contact hearing system is a system including a contact hearing device, an ear tip and an audio processor. Contact hearing systems may also include an external communication device. An example of such system is an Earlens hearing-aid. In the Earlens system, audio is received by an audio processor and transmitted by laser to a contact hearing device which is placed on the ear drum of a user.

A contact hearing device, which may also be referred to as a tympanic contact actuator or tympanic lens, includes a tiny actuator connected to a customized ring-shaped support platform that floats on the ear canal around the eardrum. The contact hearing device resides in the ear much like a contact lens resides on the surface of the eye. In a contact hearing device, an actuator directly vibrates the eardrum which causes energy to be transmitted through the middle and inner ears to stimulate the brain and produce the perception of sound. The contact hearing device may comprise a photodetector, a microactuator connected to the photodetector, and a support structure supporting the photodetector and microactuator. The contact hearing device may comprise a photodetector, a transducer connected to the photodetector, and a support structure for supporting the photodetector and the transducer. The contact hearing device may comprise a receive coil, a microactuator connected to the receive coil, and a support structure supporting the receive coil and microactuator. The contact hearing device may comprise a receive coil, a transducer connected to the receive coil, and a support structure supporting the receive coil and transducer. In alternate embodiments, the contact hearing device may include one or more coils and one or more antennas.

The Earlens contact hearing device is secured in the ear canal by using a perimeter platform, which may also be referred to as a sulcus platform, made out of a thin film of Parylene™ C. In this design, the perimeter platform surrounds the transducer and supports its position within the ear canal. In U.S. Pat. No. 9,392,377 to Olsen et al., this perimeter platform is described as being made from poly (para-xylylene) (Parylene™-N), or variants thereof, such as poly(chloro-p-xylene) (Parylene™ C), poly(p-xylene), poly (dichloro-p-xylene) (Parylene™ D), or fluorinated poly(p-xylene) (Parylene™ F). However, when a contact hearing device including a perimeter platform made from any of those materials is delivered through the ear canal it may be difficult to avoid deforming or wrinkling the Parylene™. Such wrinkles may result in permanent deformation of the intended perimeter platform geometry, and may therefore reduce the ability of the perimeter platform and, thus, the contact hearing device to resist displacement. When a displacement occurs, the contact hearing device moves from its optimal position adjacent the tympanic membrane to anew position. Movement of the contact hearing device to a new position may result in deterioration of the performance of the hearing aid. It has been observed clinically that there is a strong correlation between wrinkling of the material making up the perimeter platform and displacement, resulting in unacceptable hearing aid performance when wrinkles are present.

In a contact hearing system, a microactuator may be placed on a subject's tympanic membrane (ear drum) such that the microactuator vibrates the tympanic membrane in response to an external signal. Generally, the external signal is an acoustic signal which is converted to an electronic signal in a signal processor which forms a part of the contact hearing aid system. The electronic signal may then be converted to an optical signal. The optical signal may be transmitted to a photodetector which then converts the optical signal to mechanical motion by means of the microactuator. However, to insure optimum signal transduction between the microactuator and the tympanic membrane, the microactuator must remain in close proximity to its designed position. In the prior art system, the microactuator may be secured in position using a perimeter platform made of Parylene™ or a Parylene™ variant, such as, Parylene™ C.

One of the limitations of Parylene™ as a perimeter platform is that, once it is deformed it does not completely recover from that deformation. Deformation may occur under a number of circumstances, such as when the contact hearing device is delivered through a subject's ear canal to the tympanic membrane. Once the Parylene™ platform is deformed, it does not return to its pre-deformation shape and the resulting geometry of the perimeter platform is therefore different from the anatomy of the subject. If the perimeter platform is deformed and no longer conforms to the anatomy of the user, the contact hearing device may be more likely to become displaced from its intended position. When a contact hearing device becomes displaced, signal transduction may be impeded, resulting in reduced hearing improvement.

A perimeter platform may also be designed to ensure that the platform does not cause injury to tissues in the ear through the application of excessive pressure. Thus, the perimeter platforms may be designed to apply a slight pressure to surrounding tissue when it is placed in the ear. In particular, with the perimeter platform in place, capillaries in the surrounding tissue remain capable of re-filling with blood during each cardiac cycle. In general, the perimeter platform would be designed to apply a pressure of less than about 20 mm Hg. In order to meet this requirement, the hardness and geometry of the perimeter platform may be controlled so that it does not impose significant pressure upon the tissue.

A perimeter platform may also be made from materials which do not degrade or lose function after prolonged periods in the ear canal. Such materials would preferably be biocompatible, including meeting preset requirements for cytotoxicity, irritation and sensitization.

A perimeter platform may also be made from materials which do not swell substantially or gain weight after prolonged periods in an ear canal. Prolonged periods in an ear canal should not cause significant dimensional changes in materials used in a perimeter platform as such dimensional changes (e.g., changes in material thickness or weight) may have detrimental consequences, leading to, for example, displacement of the contact hearing device. Dimensional stability is particularly important because a precise fit is required to insure that the contact hearing device remains in its position on the ear.

SUMMARY OF THE INVENTION

The present disclosure provides apparatus having a transducer and a retention structure comprising a shape profile corresponding to a tissue of a user, and a layer of elastomer. The disclosure also provides alternate apparatus, methods of manufacture, methods of use, and kits.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In various aspects, the present disclosure provides an apparatus for placement with a user, the apparatus comprising: a transducer; and a retention structure comprising: a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns.

In some aspects, the elastomer has a Young's modulus of between 0.5 MPa and 50 MPa. In some aspects, the elastomer has a hardness of between approximately 25 A and approximately 95 A. In some aspects, the elastomer has an ultimate tensile strength of between 0.5 MPa and 5.0 MPa, or the elastomer has an ultimate tensile strength of between 5 MPa and 50 MPa. In some aspects, the layer of elastomer has a thickness of between approximately 25 microns and approximately 500 microns. In some aspects, the elastomer has an ultimate tensile strength of between approximately 1 MPa and approximately 300 MPa, between approximately 20 MPa and approximately 100 MPa, or between approximately 40 MPa and approximately 60 MPa at an elongation of approximately 650%. In some aspects, the elastomer has a tensile stress of between approximately 2.0 MPa and approximately 4.0 MPa at 50% elongation. In some aspects, the elastomer has a tensile stress of between approximately 3.0 MPa and approximately 5.0 MPa at 100% elongation.

In some aspects, the layer of elastomer has a change in Young's Modulus of less than 15%, less than 50%, or less than 75%, compared to a reference layer of elastomer following exposure to a test bath for 16 days at 37° C., the test bath comprising 10 wt % Synthetic Cerumen, 10 wt % EN1811 Sweat, and 80 wt % mineral oil. In some aspects, the layer of elastomer has a change in weight of less than 30% compared to a reference layer of elastomer, following exposure to a test bath for 16 days at 37° C., the test bath comprising 10 wt % Synthetic Cerumen, 10 wt % EN1811 Sweat, and 80 wt % mineral oil. In some aspects, the layer of elastomer has a change in wall thickness of less than 15% compared to a reference layer of elastomer, following exposure to a test bath for 16 days at 37° C., the test bath comprising 10 wt % Synthetic Cerumen, 10 wt % EN1811 Sweat, and 80 wt % mineral oil.

In some aspects, the layer of elastomer further comprises between approximately 5% and approximately 15% polydimethylsiloxane by weight, or wherein the platform material comprises between approximately 9% and approximately 11% polydimethylsiloxane by weight. In some aspects, the layer of elastomer comprises a polyurethane, a polycarbonate urethane with a silicone rubber soft segment, a polycarbonate urethane, an aromatic polyurethane, a fluoropolymer, a polyetherurethane, a nylon, a polyetherblockamide, an aliphatic polyetherurethane, a propylene, a propylene with rubber, or any combination thereof. In some aspects, the layer of elastomer comprises a polycarbonate-based silicone elastomer, a polycarbonate urethane with poly(dimethylsiloxane) soft segment, a fluoropolymer, THV [poly(tetrafluoroethylene-co-hexafluoropropylene-co-vinylidene fluoride)], a polycarbonate urethane-co-poly(dimethyl siloxane), any derivative thereof, or any combination thereof. In some aspects, the layer of elastomer comprises one or more of aliphatic polycarbonate-based thermoplastic urethane, polycarbonate urethane with poly(dimethyl siloxane) soft segment, and polycarbonate urethane-co-poly (dimethyl siloxane).

In some aspects, the retention structure comprises a curved portion having an inner surface toward an eardrum of the patient when placed, and wherein the curved portion couples to an ear canal wall of the patient, oriented toward the eardrum when placed to couple the transducer to the eardrum. In some aspects, the curved portion couples to the ear canal on a first side of the ear canal opposite the eardrum, and wherein a second portion of the retention structure couples to a second side of the ear canal opposite the first side to hold the retention structure in the ear canal. In some aspects, the curved portion and the second portion are connected so as to define an aperture extending therebetween to view at least a portion of the eardrum when the curved portion couples to the first side of the ear canal and the second portion couples to the second side.

In some aspects, the retention structure includes ridges along a tissue facing surface. In some aspects, the ridges are formed as part of a three dimensional printing process. In some aspects, the three dimensionally printed component is a mold used to form the layer of elastomer.

In some aspects, the layer of elastomer has a surface air-water contact angle of between approximately 100 degrees and approximately 130 degrees, or wherein the layer of elastomer has a surface air-water contact angle of between approximately 115 degrees and approximately 125 degrees, or wherein the layer of elastomer has a surface air-water contact angle of between approximately 20 degrees and approximately 80 degrees.

In some aspects, the apparatus further comprises an umbo platform, wherein the umbo platform comprises one or more of polycarbonate urethane with poly(dimethyl siloxane) soft segment or polycarbonate urethane-co-poly(dimethyl siloxane). In some aspects, the apparatus further comprises a coating polymer, the coating polymer comprising a poly (p-xylylene) polymer. In some aspects, the elastomer has a hardness of between 65 A and 100 A In various aspects, the present disclosure provides a method of treating a user in need of a hearing device, the method comprising: providing the user with an apparatus for placement with a user, the apparatus comprising: a transducer; and a retention structure comprising: a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns; and inserting the apparatus into an ear of the user, such that the transducer is in proximity to the eardrum of the user. In some aspects, the method further comprises the step of administering mineral oil to the apparatus, to the ear of the user, or any combination thereof.

In various aspects, the present disclosure provides a kit, the kit comprising: an apparatus for placement with a user, the apparatus comprising: a transducer; and a retention structure comprising: a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns; and instructions for use of the apparatus. In some aspects, the kit further comprises mineral oil.

In various aspects, the present disclosure provides a method of manufacturing an apparatus for placement with a user, the apparatus comprising: a transducer; and a retention structure comprising: a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns, the method comprising an injection molding process.

In various aspects, the present disclosure provides a method of manufacturing an apparatus for placement with a user, the apparatus comprising: a transducer; and a retention structure comprising: a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns, the method comprising a solvent coating process.

In various aspects, the present disclosure provides a method of manufacturing an apparatus for placement with a user, the apparatus comprising: a transducer; and a retention structure comprising: a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns, the method comprising a 3D printing process.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same or like elements. The drawings are not necessarily to scale, emphasis instead being placed upon illustrating the principles of the preferred embodiments.

DETAILED DESCRIPTION OF THE INVENTION

Figure 1:
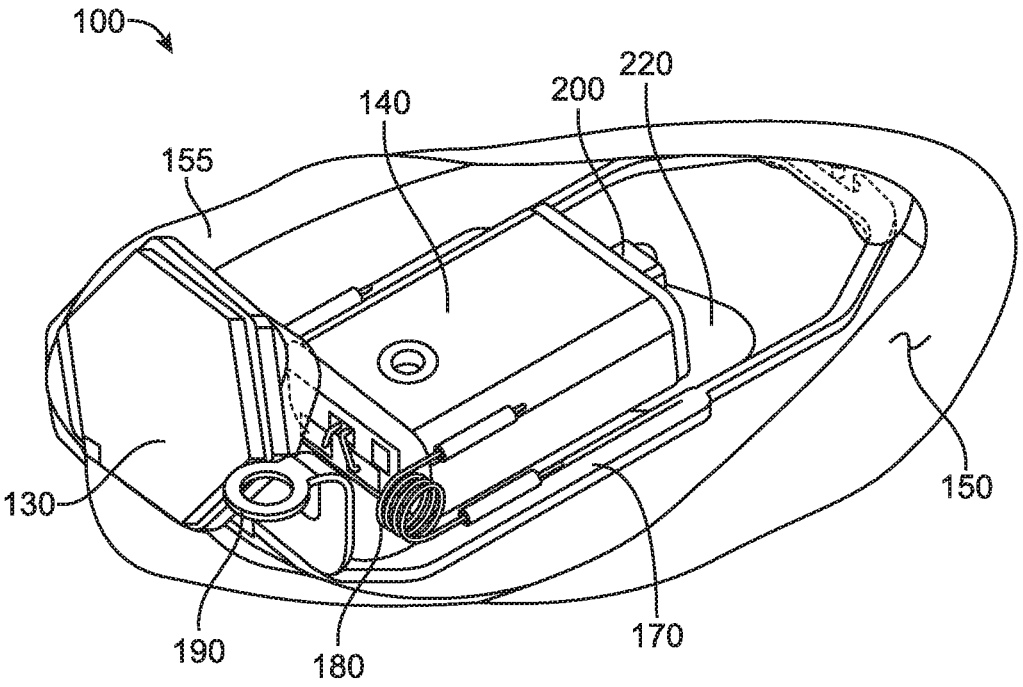
FIG. 1 is a top view of a contact hearing device according to the present invention.

In some embodiments, the present invention discloses an apparatus for placement with a user. In certain embodiments, the apparatus comprises a transducer and a retention structure, wherein the retention structure comprises a shape profile and a platform material, wherein the retention structure comprises a resilient retention structure to maintain a location of the transducer when coupled to the user, wherein the platform material has a thickness to resist deflection away from the shape profile, and wherein the platform material comprises the shape profile in an unloaded configuration. In some embodiments, the platform material comprises a layer of elastomer. In certain embodiments, the apparatus comprises a transducer and a retention structure, wherein the retention structure comprises a layer of elastomer, and wherein the layer of elastomer has a shape profile, wherein the retention structure comprises a resilient retention structure to maintain a location of the transducer when coupled to the user, wherein the elastomer has a thickness to resist deflection away from the shape profile, and wherein the elastomer comprises the shape profile in an unloaded configuration. In some embodiments, the elastomer may be coated with a coating polymer, such as a poly(p-xylylene) polymer (e.g., a Parylene™) or derivative thereof.

In some embodiments, the elastomer has a shape profile corresponding to a tissue of the user to couple the transducer to the user. As a non-limiting example, the retention structure can comprise a shape profile corresponding with the ear canal of the user, the concha of the user, the umbo of the user, the antihelix of the user, the tringular fossa of the user, the external auditory meatus of the user, the tragus of the user, the antitragus of the user, the scapha of the user, or any combination thereof. In some embodiments, the substrate has a shape profile corresponding to the tissue of the user. In some embodiments, the substrate has a shape profile corresponding to the ear canal tissue of a user. In certain embodiments, at least a portion of the substrate has a shape profile corresponding to the sulcus region of the ear canal of a user.

In some embodiments, the retention structure comprises a curved portion having an inner surface toward an eardrum of the patient when placed. In some embodiments, the retention structure comprises a curved portion having an inner surface directed toward the eardrum of the patient when placed onto the patient's ear. In some embodiments, the curved portion couples to an ear canal wall and is oriented toward the eardrum when placed. In some embodiments, the apparatus further comprises a transducer. In some embodiments, the transducer comprises an actuator. In certain embodiments, the actuator is a microactuator. In certain embodiments, the transducer comprises a microactuator, such as a balanced armature microactuator. In some embodiments, the transducer comprises a piezoelectric transducer. In certain embodiments, the transducer is a piezoelectric transducer. In certain embodiments, the apparatus is placed to couple the actuator to the eardrum. In some embodiments, the curved portion of the apparatus couples to the ear canal on a first side of the ear canal opposite the eardrum, and a second portion of the retention structure couples to a second side of the ear canal opposite the first side to hold the retention structure in the ear canal. In some embodiments, the curved portion of the apparatus and the second portion are connected so as to define an aperture extending therebetween. In some embodiments, the curved portion couples to the first side of the ear canal and the second portion couples to the second side.

In some embodiments, the apparatus comprises an output transducer assembly comprising a transducer. The output transducer assembly may be configured for placement in the medial ear canal, and is also referred to as a medial ear canal assembly. The output transducer assembly can receive a sound input, for example an audio sound or an input from an external communication device. With hearing aids for hearing impaired individuals, the input can be ambient sound. The external communication device may comprise at least one input transducer, for example a microphone. The at least one input transducer may comprise a second microphone located away from the first microphone, in the ear canal or the ear canal opening, for example positioned on a sound processor. The at least one input transducer assembly may also include a suitable amplifier or other electronic interface. In some embodiments, the input may comprise an electronic sound signal from a sound producing or receiving device, such as a telephone, a cellular telephone, a Bluetooth connection, a ratio, a digital audio unit, and the like.

In some embodiments of the invention, the output transducer assembly comprises a transducer, a photodetector, a spring, a support structure, and a retention structure.

In some embodiments of the invention, the output transducer assembly is adapted to receive the output form the input transducer assembly and produce mechanical vibrations in response to the received information, which may be, for example, in the form of a light signal generated by a lateral ear canal assembly. In some embodiments of the invention, the medial ear canal assembly or output transducer assembly comprises a sound transducer, wherein the sound transducer may comprise at least one of a microactuator, a coil, a magnet, a magnetostrictive element, a photostrictive element, or a piezoelectric element. In some embodiments of the invention, the input transducer assembly may comprise alight source coupled to sound processor by a fiber optic cable and positioned on a lateral ear canal assembly. In some embodiments of the invention, the input transducer assembly may comprise a laser diode coupled to a sound processor and positioned on the lateral ear canal assembly. In some embodiments of the invention, the light source of the input transducer assembly may be positioned in the ear canal along with a sound processor and a microphone. When properly coupled to the subject's hearing transduction pathway, the mechanical vibrations caused by the apparatus can stimulate the cochlea CO, which induces neural impulses in the subject which can be interpreted by the subject as a sound input.

In some embodiments, the platform material comprises the shape profile when in an unloaded configuration. In some embodiments, the elastomer comprises the shape profile when in an unloaded configuration. The apparatus is in an unloaded configuration when it is not coupled to the user (e.g., prior to insertion into the ear).

In some embodiments, the retention structure comprises a resilient retention structure, which will maintain the location of the actuator when coupled to the user. As a non-limiting example, the retention structure can maintain the actuator in proximity to the ear drum of the user. In certain embodiments, the retention structure maintains the actuator closer than 1 mm, closer than 2 mm, closer than 3 mm, closer than 4 mm, closer than 5 mm, closer than 6 mm, closer than 7 mm, closer than 8 mm, closer than 9 mm, closer than 10 mm, closer than 2 cm, or closer than 3 cm from the ear drum of the user. In certain embodiments, the structure can maintain the location of the actuator by the shape of the retention structure, as well as the composition of the layer of elastomer. In some embodiments, the elastomer can resist deflection away from the shape profile. In some embodiments, the retention structure can maintain the transducer in proximity to the tympanic membrane of the user.

In some embodiments, the user is a patient in need of a contact hearing apparatus. In some embodiments, the user is a mammal. In certain embodiments, the user is a human. In certain embodiments, the user is a patient suffering from hearing loss.

Figure 2:
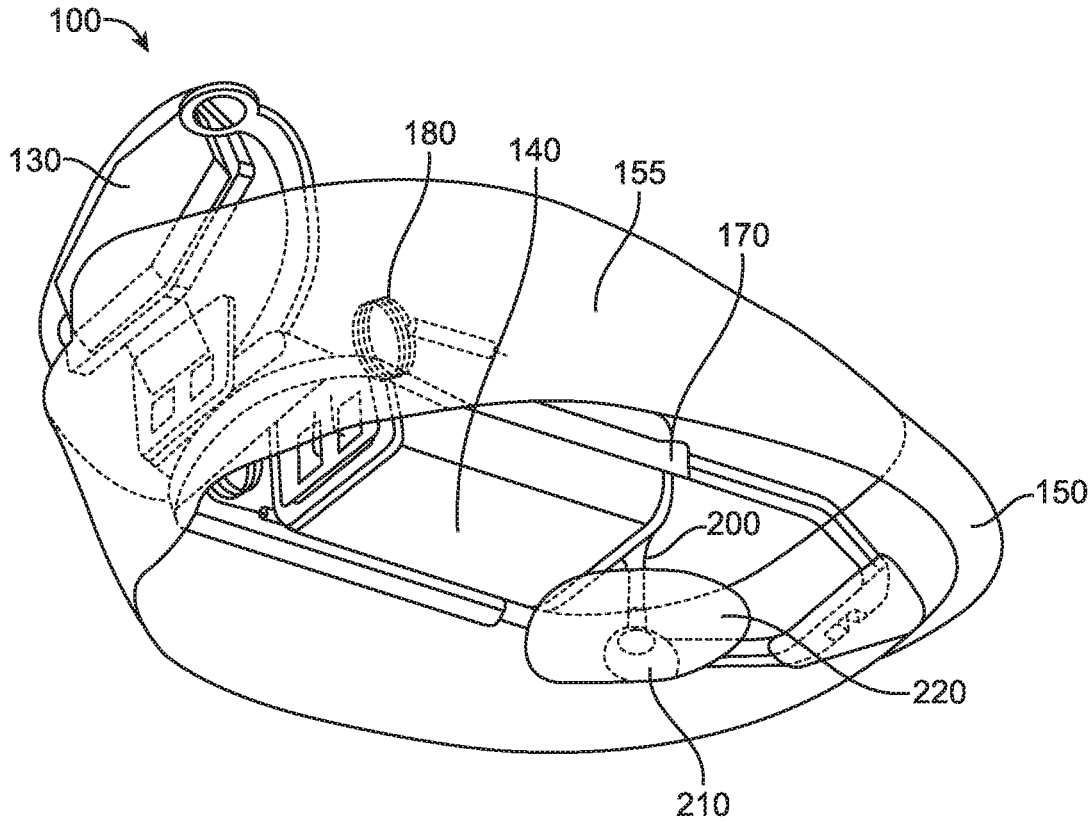
FIG. 2 is a bottom view of a contact hearing device according to the present invention.
Figure 3:
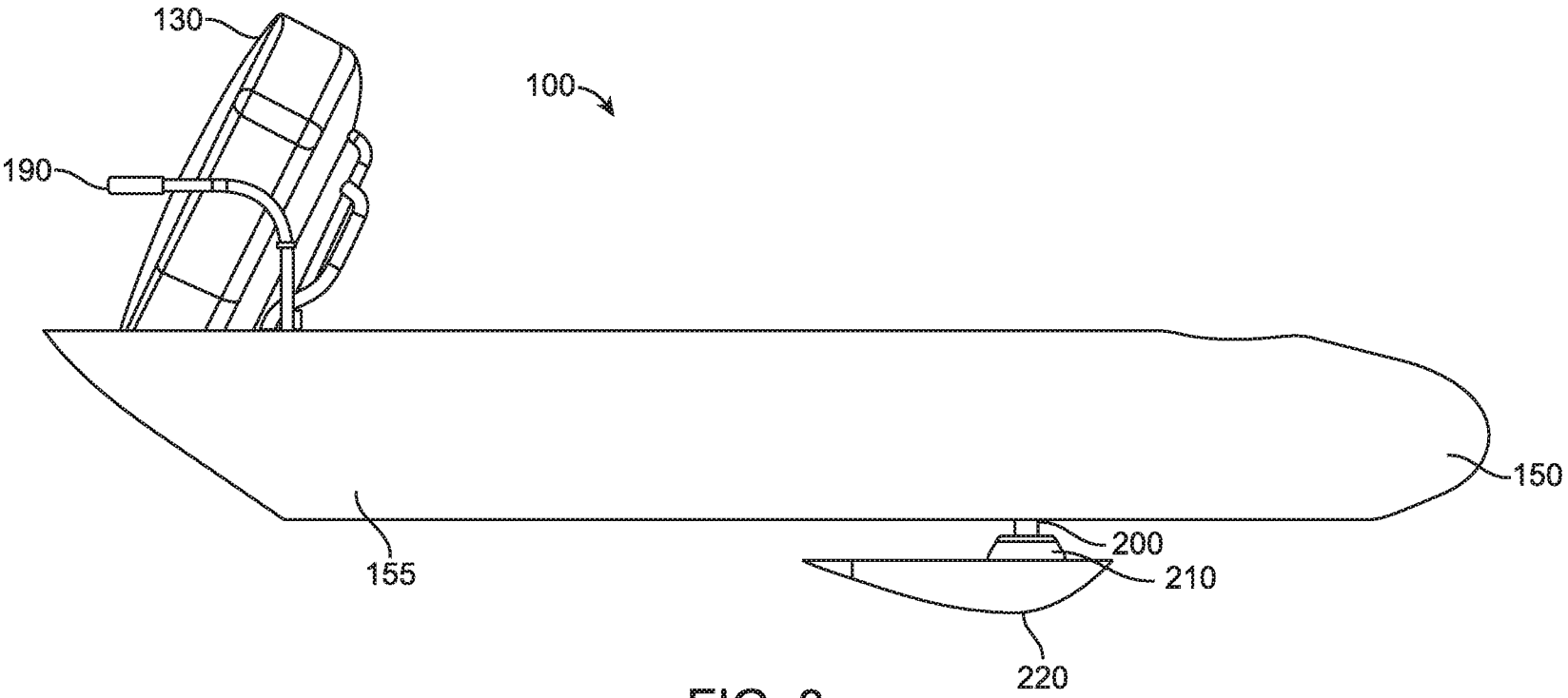
FIG. 3 is a side view of a contact hearing device according to the present invention.
Figure 4:
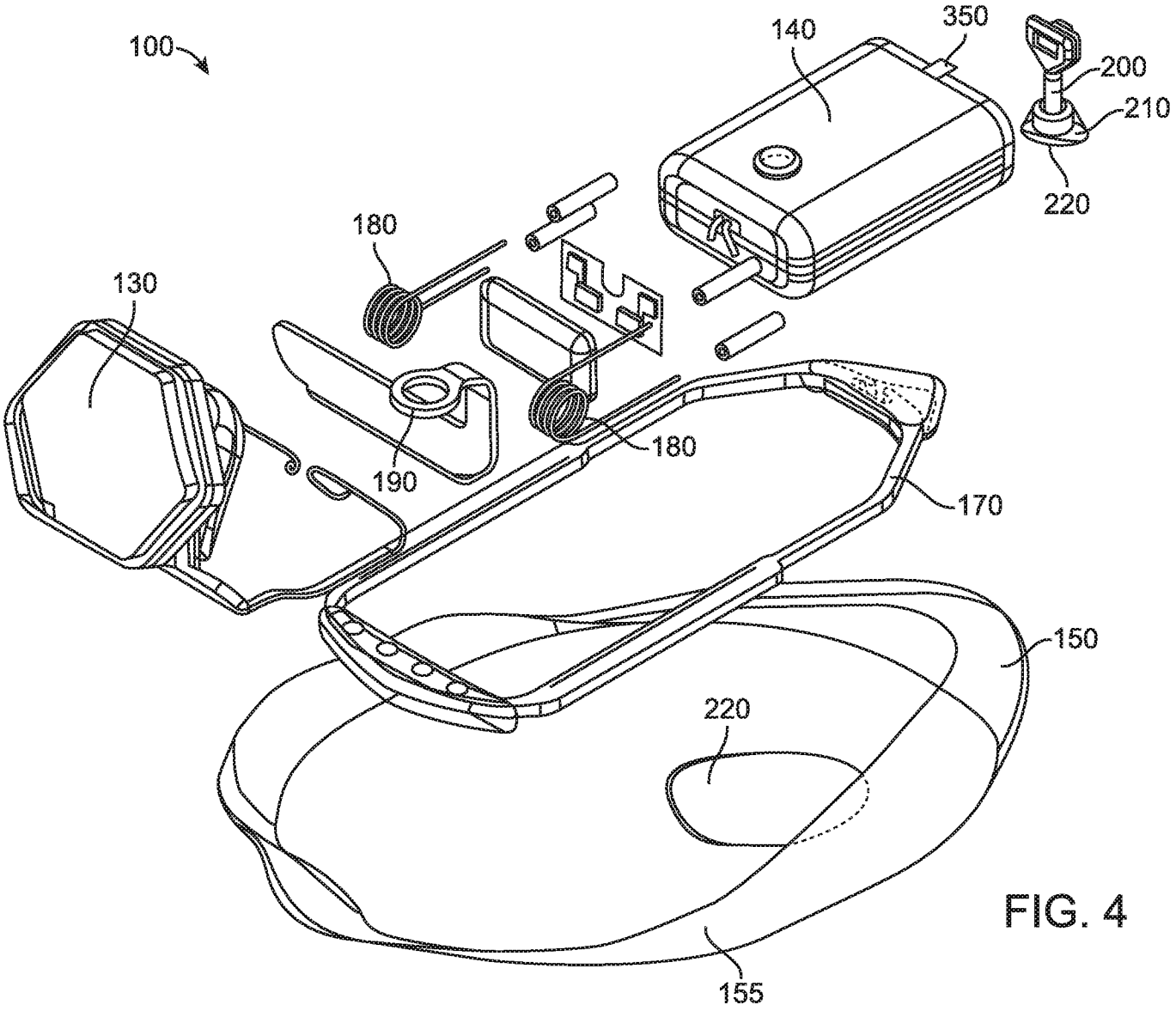
FIG. 4 is an exploded top view of a contact hearing device according to the present invention.

FIG. 1 is atop view of a contact hearing device 100 (which may also be referred to as a tympanic lens, output transducer assembly, or medial ear canal assembly) according to the present invention. FIG. 2 is a bottom view of a contact hearing device 100 according to the present invention. FIG. 3 is a side view of a contact hearing device 100 according to the present invention. FIG. 4 is an exploded top view of a contact hearing device 100 according to the present invention. In the contact hearing device of FIGS. 1, 2, 3, and 4, a perimeter platform 155 is mounted on a chassis 170. Perimeter platform 155 may include a sulcus platform 150 at one end of perimeter platform 155. Chassis 170 may further include bias springs 180 (which may also be referred to as torsion springs) mounted thereon and supporting transducer 140. Transducer 140 is connected to drive post 200, which is connected to umbo lens 240 by adhesive 210. Chassis 170 further supports grasping tab 190 and photodetector 130. In some embodiments of the invention, signals may be transmitted to contact hearing device 100 by, for example, magnetic coupling or radio frequency transmission. In some embodiments of the invention, element 130 may be a receiving coil or an antenna.

Figure 5:
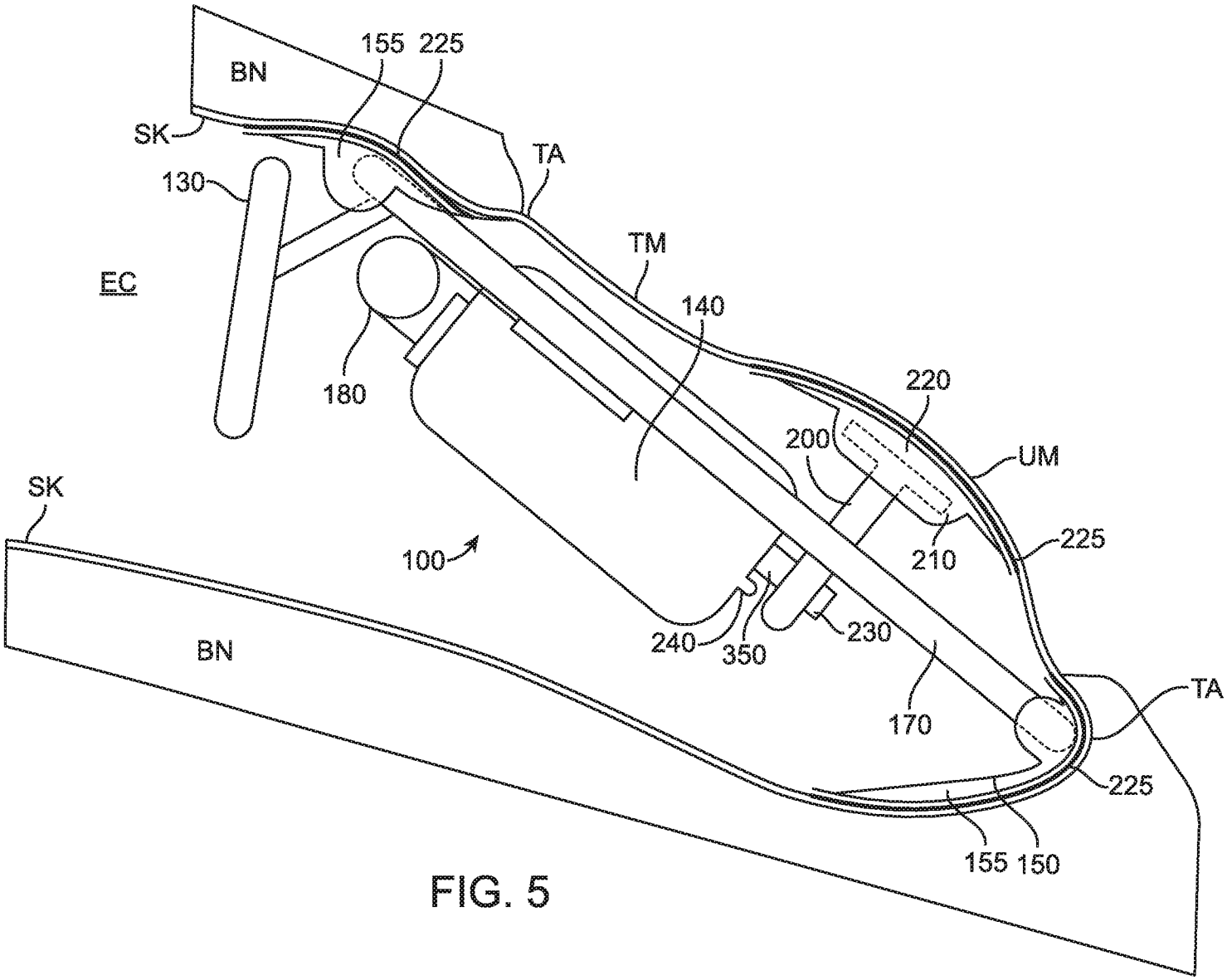
FIG. 5 is a side view of a contact hearing device according to the present invention with the contact hearing device positioned on the tympanic membrane of a user.

FIG. 5 is a further side view of a contact hearing device 100 according to the present invention where in contact hearing device 100 is positioned on the tympanic membrane TM of a user. In FIG. 5, contact hearing device 100 comprises perimeter platform 155 which includes sulcus platform 150 at one end thereof. Perimeter platform 155 is connected to chassis 170, which supports transducer 140 through bias springs 180. Transducer 140 includes transducer reed 350 extending from a distal end thereof. Transducer reed 350 is connected to umbo lens 220 through drive post 200. Chassis 170 further supports photodetector 130, which is electrically connected to transducer 140. In FIG. 5, perimeter platform 155 is positioned on skin SK covering the boney portion BN of the ear canal EC. The sulcus platform portion 150 of perimeter platform 155 is positioned at the medial end of the ear canal in the tympanic annulus TA. Umbo lens 200 is positioned on umbo UM of tympanic membrane TM. In FIG. 5, an oil layer 225, of, for example, mineral oil may be positioned between perimeter platform 155 and skin SK and between umbo lens 220 and umbo UM.

Figure 6:
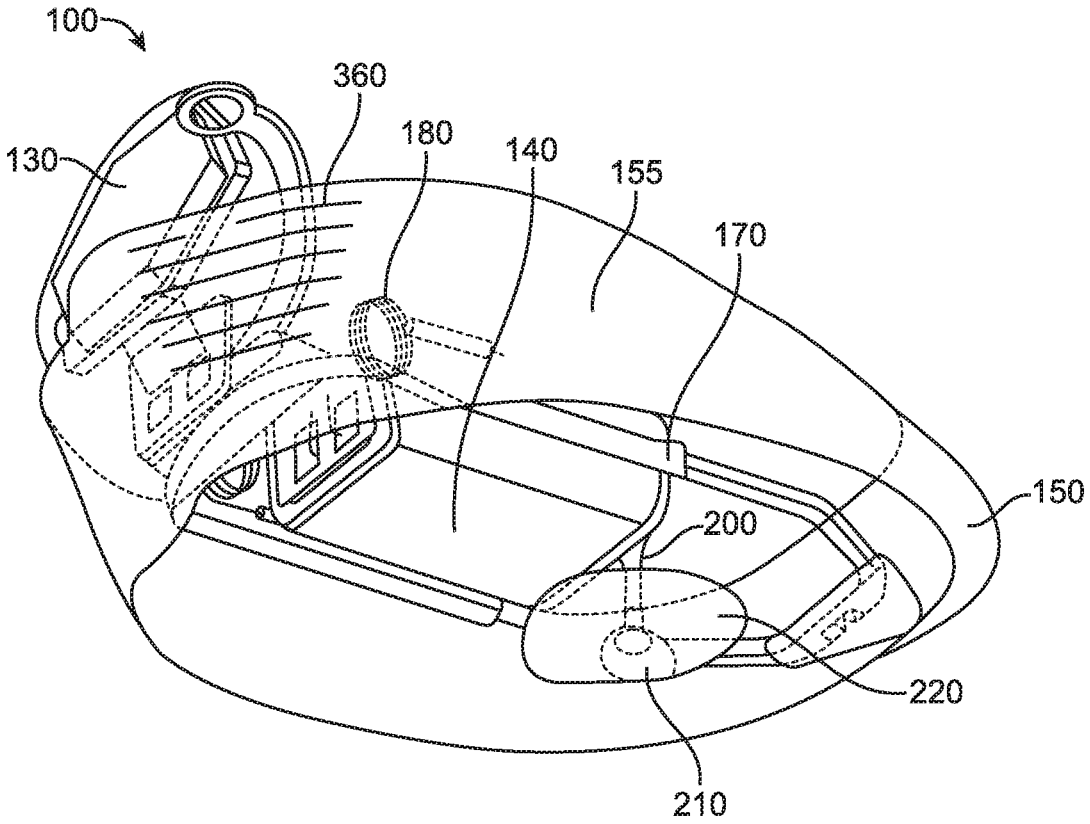
FIG. 6 is a bottom view of a contact hearing device including ridges according to the present invention.

FIG. 6 is a bottom view of a contact hearing device including ridges 360 according to the present invention. In some embodiments of the invention, the platform may retain 3D printing ridges 360, which may be, for example, used as a quality check to ensure that the platform conformed exactly to the mold. In some embodiments of the invention, the ridges may be formed when the elastomer comes into contact with the surface of the mold, where the mold is manufactured using three dimensional printing techniques. In some embodiments, the apparatus can comprise ridges along a tissue-facing surface. In certain embodiments, the apparatus comprises a elastomer comprising ridges along the tissue facing surface. In certain embodiments, the ridges are formed as a part of a three-dimensional (3D) printing process. In specific embodiments, the 3D printed component is a mold used to form the retention structure.

In order to resolve the issues described in the Background, it would be desirable to manufacture the retention platform out of a material that can recover its shape after deformation, such as the deformation experienced during delivery of a contact hearing device through an ear canal, while meeting all of the other requirements of a suitable platform material. In some embodiments, the platform material comprises a layer of elastomer. In certain embodiments, the platform material is a layer of elastomer. Elastomers represent a class of materials which can experience significant strain (often >50%) and recover their original shape once the deformation force has been relieved. In some embodiments of the invention, the use of elastomers in a retention platform for a contact hearing device may improve the stability of the contact hearing device in the ear canal. In some embodiments, the apparatus can comprise a layer of elastomer and additional layers of material. In certain embodiments, the apparatus can comprise a plurality of layers of elastomer.

In addition to the other requirements described herein, a suitable layer of elastomer according to the present invention would be a material which was optimized for one or more of the following characteristics: biocompatibility, dimensional stability, tensile modulus, surface structure and material thickness.

A suitable platform material would meet biocompatibility requirements which would ensure that it could be used in the ear of a user and, more particularly, could be placed in the ear canal of a user for an extended period of time without irritating or damaging the ear canal or components of the ear canal, including the tissue lining the ear canal. In some embodiments of the invention, suitable biocompatibility would include meeting requirements for measurements of cytotoxicity, sensitization and irritation. Such requirements may include requirements established by the International Organization for Standardization ("ISO"). In some embodiments of the invention, a suitable platform material would be expected to meet the cytotoxicity requirements of ISO 10993-5. In some embodiments of the invention, a suitable platform material would be expected to meet the sensitization requirements of ISO 10993-10. In some embodiments of the invention, a suitable platform material would be expected to meet the irritation requirements of ISO 10993-10. In some embodiments, the apparatus comprises a layer of elastomer that meets the cytotoxicity requirements of ISO 10993-5, the sensitization requirements of ISO 10993-10, and the irritation requirements of ISO-10993-10.

In some embodiments of the invention, a suitable elastomer would meet dimensional stability requirements which would ensure that key characteristics of the material would not change significantly when placed into an environment such as the ear canal of a user. In particular, the dimensional and stability requirements ensure that interaction between fluids found in the ear canal and the material would not change the key characteristics of the material in a way that detrimentally effects its performance when used in a contact hearing device, including, for example, as a sulcus or umbo platform material in a contact hearing device. Fluids which might be present in the ear canal include both physiological fluids, such as sweat or cerumen and externally introduced fluids such as mineral oil. In some embodiments of the invention, the dimensional stability of the material may be measured by comparing the raw material to material that has been soaked in a bath having a predetermined composition and measuring changes to the material after it is removed from the bath. In one embodiment of the invention, a suitable test bath may comprise a mixture of approximately 80% mineral oil, approximately 10% natural or artificial sweat and approximately 10% natural or artificial cerumen. In some embodiments of the invention, materials may be left in the test bath for a predetermined period of time. In some embodiments of the invention, materials may be left in the test bath for between sixteen (16) and thirty (30) days. In some embodiments of the invention, the test bath may be held at a predetermined temperature. In some embodiments of the invention, the test bath may be held at a temperature of between approximately 35 and approximately 39 degrees centigrade. In some embodiments of the invention, the test bath may be held at a temperature of approximately 37 degrees centigrade. The bath may separate into one or more phases since the mineral oil and cerumen phases may be immiscible with the artificial sweat phase. In some embodiments, the solution is stirred to form an emulsion. The stirring may be performed at various rates depending on the volume of the fluid test bath. In some embodiments, the stir rate is in the range from 0 to 1000 rpm, from 25 to 800 rpm, from 50 to 600 rpm, from 75 to 500 rpm, from 100 to 450 rpm, from 150 to 400 rpm, from 200 to 375 rpm, or from 250 to 350 rpm. In some embodiments, the stir rate is greater than 1 rpm, greater than 20 rpm, greater than 40 rpm, greater than 60 rpm, greater than 80 rpm, greater than 100 rpm, greater than 200 rpm, greater than 300 rpm, greater than 400 rpm, greater than 500 rpm, greater than 600 rpm, greater than 700 rpm, greater than 800 rpm, greater than 900 rpm, or greater than 1000 rpm.

Some of the key characteristics that might be expected to change when the layer of elastomer is placed into a test bath and/or into the ear canal of a user include changes to the dimensions of the platform resulting from, for example, the absorption of fluids from the ear canal. In some embodiments of the invention, such dimensional changes may include changes in the thickness of the materials, changes in the weight of the materials or changes in the tensile modulus of the materials. In certain embodiments, changes to the layer of elastomer are compared by exposing said material to a suitable test bath, comprising a mixture of approximately 80% mineral oil, approximately 10% natural or artificial sweat, and approximately 10% natural or artificial cerumen. In some embodiments, the layer of elastomer comprises material in the form of extruded tubing. The parameters (e.g., change in weight, thickness, or tensile modulus of the layer of elastomer) after said material has been left in the test bath for up to sixteen (16) days, the test bath being held at a temperature of approximately 37 degrees centigrade. The changes are compared against a reference layer of elastomer that is not subjected to the test bath.

In some embodiments of the invention, an apparatus comprising the layer of elastomer that is placed into a test bath and/or into the ear canal of a user can have a change in wall thickness. In some embodiments, the wall thickness changes would be approximately 0%. In some embodiments of the invention, wall thickness changes would be between approximately 0% and 0.5%, between approximately 0% and 1%, between approximately 0% and 2%, between approximately 0% and 3%, between approximately 0% and 4%, between approximately 0% and 5%, between approximately 0% and 6%, between approximately 0% and 7%, between approximately 0% and 8%, between approximately 0% and 9%, between approximately 0% and 10%, between approximately 0% and 15%, or between approximately 0% and 20%. In some embodiments of the invention, wall thickness changes would be less than 0.5%, less than 1%, less than 2%, less than 3%, less than 4%, less than 5%, less than 6%, less than 7%, less than 8%, less than 9%, less than 10%, less than 15%, or less tha" 20%.

In some embodiments of the invention, an apparatus comprising the layer of elastomer that is placed into a test bath and/or into the ear canal of a user can have a change in weight. In some embodiments of the invention, weight change is approximately 0% from the weight of a comparable apparatus that is not placed into a test bath and/or into the ear canal of a user. In some embodiments of the invention, weight change would be between approximately 0% and 0.5%, between approximately 0% and 1%, between approximately 0% and 2%, between approximately 0% and 3%, between approximately 0% and 4%, between approximately 0% and 5%, between approximately 0% and 6%, between approximately 0% and 7%, between approximately 0% and 8%, between approximately 0% and 9%, between approximately 0% and 10%, between approximately 0% and 11%, between approximately 0% and 12%, between approximately 0% and 13%, between approximately 0% and 14%, between approximately 0% and 15%, between approximately 0% and 20%, or between approximately 0% and 25%. In some embodiments of the invention, weight changes would be less than 0.5%, less than 1%, less than 2%, less than 3%, less than 4%, less than 5%, less than 6%, less than 7%, less than 8%, less than 9%, less than 10%, less than 1%, less than 12%, less than 13%, less than 14%, less than 15%, or less than 20% when compared to the apparatus that is not placed into a test bath and/or into the ear canal of a user.

In some embodiments of the invention, an apparatus comprising the layer of elastomer that is placed into a test bath and/or into the ear canal of a user can have changes to the tensile modulus (also referred to herein as Young's modulus) of the elastomer. In some embodiments of the invention, the change in tensile modulus would be approximately 0%. In some embodiments of the invention, changes to the tensile modulus would be between approximately 0% and 0.5%, between approximately 0% and 1%, between approximately 0% and 2%, between approximately 0% and 3%, between approximately 0% and 4%, between approximately 0% and 5%, between approximately 0% and 6%, between approximately 0% and 7%, between approximately 0% and 8%, between approximately 0% and 9%, between approximately 0% and 10%, between approximately 0% and 15%, between approximately 0% and 20%, between approximately 0% and 25%, between approximately 0% and 30%, between approximately 0% and 35%, between approximately 0% and 40%, between approximately 0% and 45%, or between approximately 0% and 50%. In some embodiments of the invention, the change in tensile modulus would be less than 0.5%, less than 1%, less than 2%, less than 3%, less than 4%, less than 5%, less than 6%, less than 7%, less than 8%, less than 9%, less than 10%, less than 11, less than 12%, less than 13%, less than 14%, less than 15%, less than 20%, less than 25%, less than 30%, less than 35%, less than 40%, less than 45%, or less than 50%. The Young's modulus can be determined, for example, by measuring the tangent value in the change of strain for a range in stress, or by dividing tensile stress by extensional strain in the elastic portion of a stress-strain curve.

In some embodiments of the invention, an apparatus comprising the layer of elastomer that is placed into a water bath can have a change in wall thickness. In some embodiments, the wall thickness changes would be approximately 0%. In some embodiments of the invention, wall thickness changes would be between approximately 0% and 0.5%, between approximately 0% and 1%, between approximately 0% and 2%, between approximately 0% and 3%, between approximately 0% and 4%, between approximately 0% and 5%, between approximately 0% and 6%, between approximately 0% and 7%, between approximately 0% and 8%, between approximately 0% and 9%, between approximately 0% and 10%, between approximately 0% and 15%, or between approximately 0% and 20%. In some embodiments of the invention, wall thickness changes would be less than 0.5%, less than 1%, less than 2%, less than 3%, less than 4%, less than 5%, less than 6%, less than 7%, less than 8%, less than 9%, less than 10%, less than 15%, or less than 20%.

In some embodiments of the invention, an apparatus comprising the layer of elastomer that is placed into a water bath can have a change in weight. In some embodiments of the invention, weight change is approximately 0% from the weight of a comparable apparatus that is not placed into a water bath. In some embodiments of the invention, weight change would be between approximately 0% and 0.5%, between approximately 0% and 1%, between approximately 0% and 2%, between approximately 0% and 3%, between approximately 0% and 4%, between approximately 0% and 5%, between approximately 0% and 6%, between approximately 0% and 7%, between approximately 0% and 8%, between approximately 0% and 9%, between approximately 0% and 10%, between approximately 0% and 11%, between approximately 0% and 12%, between approximately 0% and 13%, between approximately 0% and 14%, between approximately 0% and 15%, between approximately 0% and 20%, or between approximately 0% and 25%. In some embodiments of the invention, weight changes would be less than 0.5%, less than 1%, less than 2%, less than 3%, less than 4%, less than 5%, less than 6%, less than 7%, less than 8%, less than 9%, less than 10%, less than 11%, less than 12%, less than 13%, less than 14%, less than 15%, or less than 20% when compared to the apparatus that is not placed into a water bath.

In some embodiments of the invention, an apparatus comprising the layer of elastomer that is placed into a water bath can have changes to the tensile modulus (also referred to herein as Young's modulus) of the elastomer. In some embodiments of the invention, the change in tensile modulus would be approximately 0%. In some embodiments of the invention, changes to the tensile modulus would be between approximately 0% and 0.5%, between approximately 0% and 1%, between approximately 0% and 2%, between approximately 0% and 3%, between approximately 0% and 4%, between approximately 0% and 5%, between approximately 0% and 6%, between approximately 0% and 7%, between approximately 0% and 8%, between approximately 0% and 9%, between approximately 0% and 10%, between approximately 0% and 15%, between approximately 0% an$^{d}$ 20%, between approximately 0% and 25%, between approximately 0% and 30%, between approximately 0% and 35%, between approximately 0% and 40%, between approximately 0% and 45%, or between approximately 0% and 50%. In some embodiments of the invention, the change in tensile modulus would be less than 0.5%, less than 1%, less than 2%, less than 3%, less than 4%, less than 5%, less than 6%, less than 7%, less than 8%, less than 9%, less than 10%, less than 1%, less than 12%, less than 13%, less than 14%, less than 15%, less than 20%, less than 25%, less than 30%, less than 35%, less than 40%, less than 45%, less than 50%, less than 55%, less than 60%, less than 65%, less than 70%, or less than 75% following exposure to a test bath for 16 days at 37° C., wherein the test bath comprises 10 wt % Synthetic Cerumen, 10 wt % EN1811 Sweat, and 80 wt % mineral oil. The Young's modulus can be determined, for example, by measuring the tangent value in the change of strain for a range in stress, or by dividing tensile stress by extensional strain in the elastic portion of a stress-strain curve.

In some embodiments of the invention, the elastomer has a Young's modulus of between 0.1 MPa and 5.0 MPa, between 0.2 MPa and 4.8 MPa, between 0.3 MPa and 4.6 MPa, between 0.4 MPa and 4.3 MPa, between 0.5 MPa and 4.0 MPa, between 0.6 MPa and 3.9 MPa, between 0.7 MPa and 3.8 MPa, between 0.8 MPa and 3.7 MPa, between 0.9 MPa and 3.6 MPa, or between 1.0 MPa and 3.5 MPa. In certain embodiments of the invention, the elastomer has a Young's modulus between 0.6 MPa and 3.6 MPa. In some embodiments of the invention, the elastomer has a Young's modulus of between 1 MPa and 100 MPa, between 2 MPa and 90 MPa, between 3 MPa and 80 MPa, between 4 MPa and 70 MPa, between 5 MPa and 60 MPa, between 0.5 MPa and 50 MPa, between 1 MPa and 50 MPa, between 10 MPa and 50 MPa, between 20 MPa and 50 MPa, between 30 MPa and 50 MPa, between 40 MPa and 50 MPa, between 1 MPa and 40 MPa, between 10 MPa and 40 MPa, between 20 MPa and 40 MPa, between 30 MPa and 40 MPa, between 1 MPa and 30 MPa, between 10 MPa and 30 MPa, between 20 MPa and 30 MPa, between 1 MPa and 20 MPa, between 10 MPa and 20 MPa, or between 1 MPa and 10 MPa. In certain embodiments of the invention, the elastomer has a Young's modulus of between 5 MPa and 50 MPa. In some embodiments of the invention, the elastomer has a Young's modulus of less than 75 MPa, less than 70 Mpa, less than 65 MPa, less than 60 MPa, less than 55 MPa, less than 50 MPa, less than 45 MPa, less than 40 MPa, less than 35 MPa, less than 30 MPa, less than 25 MPa, less than 20 MPa, less than 15 MPa, less than 10 MPa, or less than 5 MPa.

In some embodiments of the invention, a suitable elastomer would meet temperature stability requirements which would ensure that key characteristics of the material would not change significantly when placed into an environment such as the ear canal of a user. In some embodiments, the elastomer is insensitive to temperatures at or near the temperature of a human ear canal. In certain embodiments, sensitivity to temperature is measured as an assessment of degradation (e.g., by microscopic analysis) following prolonged exposure (e.g., 1 month) to a temperature parameter. In some embodiments, sensitivity to temperature is determined by a change in geometric configuration, as confirmed by optical visualization, such as by scanning microscopy. In some embodiments, a elastomer is deemed insensitive to temperature following prolonged exposure if the layer of elastomer has less than 20% change in shape, less than 19% change in shape, less than 18% change in shape, less than 17% change in shape, less than 16% change in shape, less than 15% change in shape, less than 14% change in shape, less than 13% change in shape, less than 12% change in shape, less than 11% change in shape, less than 10% change in shape, less than 9% change in shape, less than 8% change in shape, less than 7% change in shape, less than 6% change in shape, less than 5% change in shape, less than 4% change in shape, less than 3% change in shape, less than 2% change in shape, less than 1% change in shape, less than 0.9% change in shape, less than 0.8% change in shape, less than 0.7% change in shape, less than 0.6% change in shape, less than 0.6% change in shape, less than 0.5% change in shape, less than 0.4% change in shape, less than 0.3% change in shape, less than 0.2% change in shape, or less than 0.1% change in shape. In some embodiments, the change in shape is measured by comparing (for example, by digitally overlaying) the platform shape before and after prolonged exposure to the temperature parameter. In some embodiments, the elastomer is insensitive to temperatures from 0° C. to 60° C., from 5° C. to 55° C., from 10° C. to 50° C., from 15° C. to 45° C., from 20° C. to 40° C., or from 25° C. to 40° C. In some embodiments, the elastomer is insensitive to temperatures from 0° C. to 100° C., from 0° C. to 90° C., from 0° C. to 80° C., from 0° C. to 70° C., from 0° C. to 60° C., from 0° C. to 55° C., from 0° C. to 50° C., from 0° C. to 45° C., or from 0° C. to 40° C. In some embodiments, the elastomer is insensitive to temperatures from 15° C. to 45° C.

In some embodiments of the invention, the suitable layer of elastomer does not display wrinkling or buckling. Wrinkling or buckling can be determined by visual inspection.

In some embodiments, the visual inspection comprises optical assistance, such as by use of a microscope or scanning microscopy.

In some embodiments, the suitable layer of elastomer is resistant to tearing on insertion and/or removal from the ear canal. In some embodiments, the suitable layer of elastomer is resistant to tearing or shape deformation during manufacture and/or clinical handling.

In some embodiments, the suitable platform material is hydrophobic. In some embodiments, the suitable platform material is hydrophilic. In certain embodiments, the suitable platform material is hydrophobic and hydrophilic (e.g., having hydrophobic regions and hydrophilic regions). In some embodiments, the suitable layer of elastomer is hydrophobic. In some embodiments, the suitable layer of elastomer is hydrophilic. In certain embodiments, the suitable layer of elastomer is hydrophobic and hydrophilic (e.g., having hydrophobic regions and hydrophilic regions). In certain embodiments, the material allows epithelial cells to pass under the perimeter platform during the natural migration of the epithelial layer, which can avoid epithelial build-up.

In some embodiments, the suitable elastomer is lipophilic. In some embodiments, the suitable elastomer is lipophobic. In some embodiments, the suitable elastomer is lipophobic and lipophilic (e.g., having lipophilic regions and lipophobic regions). In certain embodiments, the elastomer can absorb and retain mineral oil. The measurement of mineral oil absorption can be measured by the swelling of the elastomer following exposure to said mineral oil. For example, an increase of mass of an elastomer exposed to mineral oil can indicate the elastomer is swelling with mineral oil absorption. In some embodiments, the layer of elastomer mass increases by greater than 1%, greater than 2%, greater than 3%, greater than 4%, greater than 5%, greater than 6%, greater than 7%, greater than 8%, greater than 9%, greater than 10%, greater than 15%, greater than 20%, or greater than 25% following exposure of the elastomer to mineral oil. In some embodiments, the mass of the apparatus increases by greater than 1%, greater than 2%, greater than 3%, greater than 4%, greater than 5%, greater than 6%, greater than 7%, greater than 8%, greater than 9%, greater than 10%, greater than 15%, greater than 20%, or greater than 25% following exposure of the layer of elastomer to mineral oil. In some embodiments, the apparatus can elute mineral oil.

In some embodiments of the invention, the suitable layer of elastomer comprises an elastomer with an ultimate tensile strength modulus measured at an elongation of approximately 650%. In some embodiments of the invention, a suitable elastomer would have an ultimate tensile strength modulus of between approximately 1 MegaPascal (MPa) and approximately 300 MPa at an elongation of approximately 650%. In some embodiments of the invention, a suitable elastomer would have an ultimate tensile strength modulus of between 20 MPa and 100 MPa at an elongation of approximately 650%. In some embodiments of the invention, the suitable elastomer has an ultimate tensile strength modulus of between 40 MPa and 60 MPa at an elongation of approximately 650%. In some embodiments of the invention, the suitable layer has an ultimate tensile strength modulus of from 1 MPa to 500 MPa, from 5 MPa to 400 MPa, from 10 MPa to 300 MPa, from 15 MPa to 200 MPa, from 20 MPa to 150 MPa, from 25 MPa to 100 MPa, from 30 MPa to 75 MPa, from 35 MPa to 70 MPa, or from 40 MPa to 60 MPa at an elongation of approximately 650%. In some embodiments of the invention, the suitable elastomer has an ultimate tensile strength modulus of from 1 MPa to 200 MPa, from 5 MPa to 150 MPa, from 10 MPa to 100 MPa, from 15 MPa to 90 MPa, from 20 MPa to 80 MPa, from 25 MPa to 70 MPa, or from 30 MPa to 60 MPa at an elongation of approximately 650%. In some embodiments of the invention, the suitable elastomer has an ultimate tensile strength modulus less than 200 MPa, less than 150 MPa, less than 100 MPa, less than 90 MPa, less than 80 MPa, less than 70 MPa, less than 60 MPa, less than 50 MPa, or less than 40 MPa at an elongation of approximately 650%.

In some embodiments of the invention, a suitable elastomer would have optimal elasticity, including an optimal tensile stress. In some embodiments, the elastomer has a tensile stress of between 1.0 MPa and 5.0 MPa, between 1.1 MPa and 4.9 MPa, between 1.2 MPa and 4.8 MPa, between 1.3 MPa and 4.7 MPa, between 1.4 MPa and 4.6 MPa, between 1.5 MPa and 4.5 MPa, between 1.6 MPa and 4.4 MPa, between 1.7 MPa and 4.3 MPa, between 1.8 MPa and 4.2 MPa, between 1.9 MPa and 4.1 MPa, or between 2.0 MPa and 4.0 MPa at 50% elongation. In some embodiments, the suitable elastomer has a tensile stress of between 0.1 MPa and 10 MPa, between 0.2 MPa and 9 MPa, between 0.3 MPa and 8 MPa, between 0.4 MPa and 7 MPa, or between 0.5 MPa and 6 MPa at 50% elongation. In some embodiments, the suitable elastomer has a tensile stress of between approximately 2.0 MPa and approximately 4.0 MPa at 50% elongation. In some embodiments of the invention, a suitable elastomer would have a tensile stress of between approximately 2.4 MPa and approximately 4.2 MPa at 50% elongation.

In some embodiments of the invention, a suitable elastomer has a tensile stress of between 0.1 MPa and 10 MPa, between 0.5 MPa and 9 MPa, between 0.7 MPa 8 MPa, between 1.0 MPa and 7.0 MPa, between 1.1 MPa and 6.9 MPa, between 1.2 MPa and 6.8 MPa, between 1.3 MPa and 6.7 MPa, between 1.4 MPa and 6.6 MPa, between 1.5 MPa and 6.5 MPa, between 1.6 MPa and 6.4 MPa, between 1.7 MPa and 6.3 MPa, between 1.8 MPa and 6.2 MPa, between 1.9 MPa and 6.1 MPa, between 2.0 MPa and 6.0 MPa, between 2.1 MPa and 5.9 MPa, between 2.2 MPa and 5.8 MPa, between 2.3 MPa and 5.7 MPa, between 2.4 MPa and 5.6 MPa, between 2.5 MPa and 5.5 MPa, between 2.6 MPa and 5.4 MPa, between 2.7 MPa and 5.3 MPa, between 2.8 MPa and 5.2 MPa, between 2.9 MPa and 5.1 MPa, or between 3.0 MPa and 5.0 MPa at 100% elongation. In some embodiments of the invention, a suitable elastomer has a tensile stress of between 3.0 MPa and 5.0 MPa at 100% elongation. In some embodiments of the invention, a suitable elastomer would have a tensile stress of between approximately 3.4 MPa and approximately 5.5 MPa at 100% elongation.

In some embodiments, the suitable layer of elastomer has a thickness of less than 500 microns, less than 450 microns, less than 400 microns, less than 350 microns, less than 300 microns, less than 250 microns, less than 200 microns, less than 175 microns, less than 150 microns, less than 125 microns, less than 100 microns, less than 90 microns, less than 80 microns, less than 70 microns, less than 60 microns, or less than 50 microns. In some embodiments, the suitable layer of elastomer has a thickness of between 1 micron and 500 microns, between 5 microns and 500 microns, between 10 microns and 500 microns, between 15 microns and 500 microns, between 20 microns and 500 microns, between 25 microns and 500 microns, between 50 microns and 500 microns, between 75 microns and 500 microns, between 100 microns and 500 microns, between 150 microns and 500 microns, between 200 microns and 500 microns, between 250 microns and 500 microns, or between 300 microns and 500 microns. In some embodiments of the invention, a suitable layer of elastomer would have a thickness of between approximately 25 microns and approximately 500 microns. In some embodiments of the invention, a suitable layer of elastomer would have a thickness of between approximately 75 microns and approximately 500 microns.

In some embodiments, the suitable umbo platform material has a thickness of between 1 micron and 500 microns, between 5 microns and 400 microns, between 10 microns and 300 microns, between 15 microns and 200 microns, between 20 microns and 150 microns, between 25 microns and 100 microns, between 30 microns and 90 microns, between 40 microns and 80 microns, or between 50 microns and 70 microns. In some embodiments, the umbo platform material has a thickness of less than 200 microns, less than 190 microns, less than 180 microns, less than 170 microns, less than 160 microns, less than 150 microns, less than 140 microns, less than 130 microns, less than 120 microns, less than 110 microns, less than 100 microns, less than 90 microns, less than 80 microns, less than 70 microns, less than 60 microns, or less than 50 microns. In some embodiments of the invention, the suitable umbo platform material would have a thickness of between approximately 25 microns and approximately 100 microns. In some embodiments, the umbo platform material comprises a layer of elastomer. In some embodiments, the umbo platform material is a layer of elastomer.

In some embodiments of the invention, a suitable layer of elastomer would have surface characteristics which are optimized for use in a direct drive device according to the present invention. In some embodiments of the invention, an appropriate material would have surface characteristics including surface energy and surface roughness. In some embodiments, the suitable layer of elastomer has a surface air-water contact angle of between 80 degrees and 150 degrees, 85 degrees and 145 degrees, 90 degrees and 140 degrees, 95 degrees and 135 degrees, 100 degrees and 130 degrees, 101 degrees and 129 degrees, 102 degrees and 128 degrees, 103 degrees and 127 degrees, 104 degrees and 126 degrees, 105 degrees and 125 degrees, 106 degrees and 124 degrees, 107 degrees and 123 degrees, 108 degrees and 122 degrees, 109 degrees and 121 degrees, 110 degrees and 120 degrees, 119 degrees and 121 degrees, 118 degrees and 122 degrees, 117 degrees and 123 degrees, 116 degrees and 124 degrees, 115 degrees and 125 degrees, 114 degrees and 126 degrees, 113 degrees and 127 degrees, 112 degrees and 128 degrees, 111 degrees and 129 degrees, or 110 degrees and 130 degrees. In some embodiments of the invention, a suitable layer of elastomer would have a surface air-water contact angle of between approximately 100 degrees and 130 degrees. In some embodiments of the invention, a suitable layer of elastomer would have a surface air-water contact angle of approximately 110, 111, 112, 113, 114, 115, 116, 117, 118, 119, 120, 121, 122, 123, 124, 125, 126, 127, 128, 129, or 130 degrees. In certain embodiments, the suitable layer of elastomer has a surface air-water contact angle of approximately 120 degrees. In some embodiments of the invention, the suitable layer of elastomer has a surface air-to-water contact angle of between 20 degrees and 80 degrees, 25 degrees and 75 degrees, 30 degrees and 70 degrees, 35 degrees and 65 degrees, or 40 degrees and 60 degrees. In some embodiments, the layer of elastomer has a surface air-to-water contact angle of less than 80 degrees, less than 75 degrees, less than 70 degrees, less than 65 degrees, less than 60 degrees, less than 55 degrees, less than 50 degrees, less than 45 degrees, less than 40 degrees, less than 35 degrees, or less than 30 degrees.

In some embodiments of the invention, a suitable platform material would include 3D printing features. In some embodiments of the invention, a suitable platform material would include 3D printing features having a depth of approximately 25 microns. In some embodiments of the invention, a suitable platform material would include a layer of elastomer having 3D printing features having a depth of approximately 25 microns. In some embodiments, the platform material comprises a layer of elastomer. In some embodiments of the invention, the tissue facing surface of a suitable platform material would include lines space at a predetermined distance apart. In some embodiments of the invention, a suitable platform material would include lines space approximately 25 microns apart. In some embodiments of the invention, the lines may result from print lines in the ear canal mold that is used to form the sulcus platform. In some embodiments of the invention, the presence of the lines may be used as an indicator that the sulcus platform was properly and uniformly deposited on the mold to accurately take the shape of the anatomy of the patient reflected in the mold. In certain embodiments, the suitable platform material comprises a layer of elastomer. In some embodiments, the suitable platform material is a layer of elastomer.

In some embodiments of the invention, a suitable platform material comprises a hardness rating measured on the Shore A hardness scale. In certain embodiments, the platform material has a hardness rating between 75 and 90 on the Shore A hardness scale. In some embodiments, the platform material has a hardness rating between 80 and 85, between 75 and 90, between 70 and 95, or between 65 and 100 on the Shore A hardness scale. In certain embodiments, the platform material comprises a layer of elastomer having a hardness rating between 75 and 90 on the Shore A hardness scale. In some embodiments, the elastomer has a hardness rating between 80 and 85, between 75 and 90, between 70 and 95, or between 65 and 100 on the Shore A hardness scale. In certain embodiments, the elastomer has a hardness rating between 0 and 100, between 10 and 100, between 20 and 100, between 30 and 100, between 40 and 100, between 50 and 100, between 60 and 100, between 70 and 100, or between 80 and 100 on the Shore A hardness scale. In some embodiments of the invention, a suitable layer of elastomer may comprise, for example, a polycarbonate-based silicone elastomer (e.g., a ChronoSil®). In some embodiments of the invention a suitable layer of elastomer may comprise, for example, an aliphatic polycarbonate-based thermoplastic urethane (e.g., ChronoFlex® AL) having a hardness rating of between approximately 75 and approximately 90 on the Shore A hardness scale.

In some embodiments of the invention, the layer of elastomer would include polydimethylsiloxane. In some embodiments, the layer of elastomer comprises from 0.1% to 25%, from 1% to 24%, from 2% to 23%, from 3% to 22%, from 4% to 21%, from 5% to 20%, from 6% to 19%, from 7% to 18%, from 8% to 17%, from 9% to 16%, from 10% to 15%, from 9% to 11%, from 8% to 12%, from 7% to 13%, from 6% to 14%, from 5% to 15%, from 1% to 2%, from 1% to 3%, from 1% to 4%, from 1% to 5%, from 1% to 6%, from 1% to 7%, from 1% to 8%, from 1% to 9%, from 1% to 10%, from 1% to 11%, from 1% to 12%, from 1% to 13%, from 1% to 14%, from 1% to 15%, from 1% to 16%, from 1% to 17%, from 1% to 18%, from 1% to 19%, or from 1% to 20% polydimethylsiloxane by weight. In some embodiments, the layer of elastomer comprises between approximately 5% and approximately 15% polydimethylsiloxane by weight. In some embodiments, the layer of elastomer comprises approximately 10% polydimethylsiloxane by weight.

In some embodiments of the invention, elastomers which have shown durability and possess elasticity making them suitable for use in a perimeter platform include polyurethanes, such as ChronoSil® (from AdvanSource Biomaterials) and BioNate® (from DSM). In some embodiments of the invention, elastomers which have shown durability and possess elasticity making them suitable for use in a perimeter platform include fluoropolymers such as polytetrafluoroethylene-co-hexafluoropropylene-co-vinylidene fluoride (from THV and THVP, 3M). In some embodiments of the invention, suitable platform materials may also include a thermoplastic elastomer comprising polyamide and polyether (e.g., Pebax® 7433 from Arkema). In some embodiments of the invention, suitable platform materials may also include polycarbonate urethane with poly(dimethyl siloxane) soft segment. In some embodiments of the invention, suitable platform materials may include polycarbonate urethane-co-poly(dimethyl siloxane).

In some embodiments, the platform material comprises a layer of elastomer. In some embodiments, the elastomer can comprise a styrenic block copolymer (SBC), a silicone rubber, an elastomeric alloy, a thermoplastic, a thermoplastic elastomer (TPE), a thermoplastic vulcanizate (TPV) elastomer, a polyurethane elastomer, a block copolymer elastomer, a polyolefin blend elastomer, a thermoplastic co-polyester elastomer, a thermoplastic polyamide elastomer, or any combination thereof (e.g., a blend of at least two of the listed materials). In some embodiments, the elastomer can comprise a polyester, a co-polyester, a polycarbonate, a thermoplastic polyurethane, a polypropylene, a polyethylene, a polypropylene and polyethylene copolymer, an acrylic, a cyclic block copolymer, a polyetheretherketone, a polyamide, a polyethylene terephthalate, a polybutylene terephthalate, a polyetherimide, a polyethersulfone, a polytrimethylene terephthalate, or any combination thereof. In some embodiments, the layer of elastomer comprises a blend, a layered material, or a combination thereof. In some embodiments, the layer of elastomer can comprise a blend of the above-disclosed elastomers, a combination of the above-disclosed elastomers, a plurality of layers comprising the above-disclosed elastomers, or any combination thereof.

In some embodiments, the elastomer can comprise a polyurethane, a polycarbonate urethane with a silicone rubber soft segment, a polycarbonate urethane, an aromatic polyurethane, a fluoropolymer, a polyetherurethane, a nylon, a polyetherblockamide, an aliphatic polyetherurethane, a polyetherurethane, a propylene, a propylene with rubber, or any combination thereof. In some embodiments, the platform material can comprise a layer of elastomer, the elastomer comprising a polyurethane (e.g., a ChronoSil®), a fluoropolymer, THV [poly(tetrafluoroethylene-co-hexafluoropropylene-co-vinylidene fluoride)], a polycarbonate urethane with poly(dimethylsiloxane) soft segment, a polycarbonate urethane-co-poly(dimethyl siloxane), any derivative thereof, or any combination thereof. In certain embodiments, the elastomer can comprise ChronoSil® 75A, Chronosil® 55D, Chronosil® 75D, Chronosil® 45D, THV 221GZ, BioNate 80A, BioNate II 80A, THVP 2030, Pebax 7233, Pebax 7433, Elastollan 85A, Elastollan 95A, THV AZ, Santoprene, Estane 58300, any derivative thereof, or any combination thereof. In some embodiments, the elastomer can comprise a silicone rubber, a poly dimethylsiloxane (PDMS), a polycarbonate urethane, a polyether urethane variotherm, a polyether urethane urea, a polyurethane poly (dimethoylsiloxane), a nitinol, Carbo 3D EPU 60, Visijet M2ENT, a poly(p-xylylene) polymer (e.g., a Parylene™), any derivative thereof, or any combination thereof. In some embodiments, the platform material comprises a blend, a layered material, or a combination thereof. In some embodiments, the platform material can comprise a blend of the above-disclosed elastomers, a combination of the above-disclosed elastomers, a plurality of layers comprising the above-disclosed elastomers, or any combination thereof.

In some embodiments, the layer of elastomer is coated with a coating polymer. The coating polymer can, for example, provide additional stiffness to the apparatus. In some embodiments, the coating polymer can provide additional features to the structure, such as increasing comfort for the user, providing increased absorption of mineral oil, or preventing deformation of the apparatus. In some embodiments, the coating polymer comprises aromatic hydrocarbon monomers. In certain embodiments, the coating polymer comprises a poly(p-xylylene) polymer (e.g., a Parylene™) or any derivative thereof. In some embodiments, the retention structure comprises the layer of elastomer coated with a coating polymer. The coating polymer can completely surround the retention structure, or can surround a portion of the retention structure. In certain embodiments, the coating polymer can surround greater than 10% of the retention structure surface area, greater than 20% of the retention structure surface area, greater than 30% of the retention structure surface area, greater than 40% of the retention structure surface area, greater than 50% of the retention structure surface area, greater than 60% of the retention structure surface area, greater than 70% of the retention structure surface area, greater than 75% of the retention structure surface area, greater than 80% of the retention structure surface area, greater than 85% of the retention structure surface area, greater than 90% of the retention structure surface area, greater than 91% of the retention structure surface area, greater than 92% of the retention structure surface area, greater than 93% of the retention structure surface area, greater than 94% of the retention structure surface area, greater than 95% of the retention structure surface area, greater than 96% of the retention structure surface area, greater than 97% of the retention structure surface area, greater than 98% of the retention structure surface area, or greater than 99% of the retention structure surface area. In certain embodiments, the coating polymer can surround greater than 10% of the layer of elastomer surface area, greater than 20% of the layer of elastomer surface area, greater than 30% of the layer of elastomer surface area, greater than 40% of the layer of elastomer surface area, greater than 50% of the layer of elastomer surface area, greater than 60% of the layer of elastomer surface area, greater than 70% of the layer of elastomer surface area, greater than 75% of the layer of elastomer surface area, greater than 80% of the layer of elastomer surface area, greater than 85% of the layer of elastomer surface area, greater than 90% of the layer of elastomer surface area, greater than 91% of the layer of elastomer surface area, greater than 92% of the layer of elastomer surface area, greater than 93% of the layer of elastomer surface area, greater than 94% of the layer of elastomer surface area, greater than 95% of the layer of elastomer surface area, greater than 96% of the layer of elastomer surface area, greater than 97% of the layer of elastomer surface area, greater than 98% of the layer of elastomer surface area, or greater than 99% of the layer of elastomer surface area.

In some embodiments of the invention, the perimeter platform may be made out of a material which can recover its intended geometry almost completely following delivery and placement. In some embodiments of the invention elastomers represent a class of materials which may address these issues.

In some embodiments of the invention, standard manufacturing methods may be used to manufacture perimeter platforms and umbo platforms using materials described herein. In some embodiments of the invention, the perimeter platform may be manufactured using a variety of methods, including vacuum forming, dip coating, thermoforming, injection molding, or blow molding. In some embodiments of the invention, in the case of blow molding, because the specific geometry of each perimeter platform is unique to an individual subject, the mold must also have a unique geometry. In some embodiments of the invention, a suitable method for preparing such a mold is by 3D printing.

In some embodiments of the invention, the term platform material may be used to refer to the perimeter platform, the sulcus platform, the retention structure, and/or the umbo platform.

In some embodiments of the invention, the perimeter platform may have a variable wall thickness, ranging between approximately 175 microns in a first region of the perimeter platform and approximately 400 microns in a second portion of the perimeter platform. In some embodiments of the invention, the umbo platform may have variable wall thicknesses, ranging from approximately 50 microns in a first region of the umbo platform to approximately 150 microns in a second region of the umbo platform.

In some embodiments of the invention, the perimeter platform may have a weight of approximately 20 milligrams. In some embodiments of the invention, the perimeter platform may have a weight in the range of between approximately 5 milligrams to approximately 20 milligrams. In some embodiments of the invention, the umbo platform may have a weight of approximately 1 milligram. In some embodiments of the invention, the umbo platform may have a weight of between approximately 1 milligram and approximately 2 milligrams.

In some embodiments of the invention, the perimeter platform and umbo platform may be coated in oil, such as, for example, mineral oil. In some embodiments, the platform material can be coated with a coating having properties similar to mineral oil. In certain embodiments, the platform material can be bonded to a coating having properties similar to mineral oil. In some embodiments, the layer of elastomer can be coated with a coating having properties similar to mineral oil. In certain embodiments, the layer of elastomer can be bonded to a coating having properties similar to mineral oil. In some embodiments, the retention structure can be coated with a coating having properties similar to mineral oil. In certain embodiments, the retention structure can be bonded to a coating having properties similar to mineral oil. In some embodiments, the similarities between the coating and the mineral oil comprise lipophilicity and/or hydrophobicity.

Methods of Using the Apparatus

In some embodiments of the invention, an apparatus as described herein can be used to provide treatment to a user in need. A method of treating a user in need of a hearing device can comprise: (i) providing the user with the apparatus as described herein; and (ii) inserting the apparatus into an ear of the user, such that a transducer on the apparatus is in proximity to the eardrum of the user. In some embodiments, the method further comprises the step of administering mineral oil to the apparatus, to the ear of the user, or any combination thereof.

Kits Comprising the Apparatus

In some embodiments of the invention, a kit comprising an apparatus as described herein is disclosed. A kit can comprise: (i) the apparatus as described herein; and (ii) instructions for using the apparatus. In some embodiments, the kit further comprises mineral oil.

Methods of Manufacturing the Apparatus

In some embodiments of the invention, a method of manufacturing an apparatus as described herein is disclosed. In some embodiments, the method of manufacturing an apparatus as described herein comprises an injection molding process. In some embodiments, the method of manufacturing an apparatus as described herein comprises a solvent coating process. In some embodiments, the method of manufacturing an apparatus as described herein comprises a 3D printing process. In some embodiments, the method of manufacturing an apparatus as described herein can comprise an injection molding process, a solvent coating process, a 3D printing process, or any combination thereof. In some embodiments, the method of manufacturing an apparatus can comprise extruding platform material in the form of extruded tubing.

EXAMPLES

The specific dimensions of any of the apparatuses, methods, kits, and components thereof, of the present disclosure can be readily varied depending upon the intended application, as will be apparent to those of skill in the art in view of the disclosure herein. Moreover, it is understood that the examples and aspects described herein are for illustrative purposes only and that various modifications or changes in light thereof can be suggested to persons skilled in the art and are included within the spirit and purview of this application and scope of the appended claims. Numerous different combinations of aspects described herein are possible, and such combinations are considered part of the present disclosure. In addition, all features discussed in connection with any one aspect herein can be readily adapted for use in other aspects herein. The use of different terms or reference numerals for similar features in different aspects does not necessarily imply differences other than those expressly set forth. Accordingly, the present disclosure is intended to be described solely by reference to the appended claims, and not limited to the aspects disclosed herein.

Example 1

Elastomer Changes Following Mineral Oil Bath Test

This example describes a procedure for simulating ear canal exposure in an ex vivo setting. This protocol provides details for testing materials to provide accelerated, and optionally head-to-head comparisons of a variety of 3D-printed polymeric materials to fluid uptake or changes in material properties when exposed to the chemical environment of the ear canal.

ChronoSil® 75A, 10% silicone that has been thermally processed by blown molding but is in the tubular area of the mold and has a regular cylindrical geometry serves as a control. Samples for testing of swelling and dimensional changes (also referred to herein as coupons) have initial dimensions of 12.5×37.5 mm with a thickness of 500 microns. Coupons are measured for length and width using calipers, and thickness using a snap gauge. Coupons are weighed using an analytical balance.

The test bath is prepared using 25 grams (10 wt %) of Synthetic Cerumen, 25 grams (10 wt %) of EN1811 Sweat, and 200 grams (80 wt %) mineral oil. The Synthetic Cerumen is prepared by mixing 240 grams (44.4 wt %) Lanolin, 120 grams (22.2 wt %) palmitic Acid, 60 grams (11.1 wt %) myristic acid, 60 grams (11.1 wt %) oleic acid, 60 grams (11.1 wt %) linoleic acid, and 0.1 grams Vitamin E. The EN1811 Sweat is prepared by mixing an aqueous solution containing 5.00 g/L (0.50 wt %) NaCl, 1.00 g/L (0.10 wt %) urea, 1.00 g/L (0.10 wt %) DL-lactic acid, and trace amounts of $NH_4OH$ sufficient to adjust the pH to approximately 6.6.

A glass beaker with the simulated canal exposure solution is placed on a hot plate with a stirrer and a thermometer. The solution temperature is maintained at either 37±2° C. for standard test conditions, or 60±2° C. for accelerated test conditions.

Material samples are conditioned in deionized water, and preliminary dimensional and weight measurements are taken. Samples are submerged into the solution, and stirring is contained at 300±50 rpm in order to maintain a singular emulsion phase. Length, width, thickness, and weight changes are measured at 1 day, 2 days, 5 days, and 16 days in standard conditions (at 5 hours, 10 hours, 1 day, and 3 days in accelerated conditions). Samples are blotted dry with a lint-free cloth prior to measuring.

In some instances, the testing samples are prepared in dog bone shape, with specific dimensions depending on the modulus of the material, such that the target test load is less than 100 N. Dog bone shaped samples are used for tensile testing. Dog bones are measured for tensile modulus after the final time point of the study (i.e., 16 days for standard conditions, and 3 days for accelerated conditions).

Samples of materials are tested for hardness using a durometer gage, both in dry state and after fluid exposure. Materials showing favorable outcomes are further studied as printed 3D perimeter platforms, which are dusted (if needed) and scanned before and after immersion in water and test bath.

Tested materials are compared to reference materials that are not exposed to the bath test, and percent changes of weight, thickness, and Young's modulus are determined.

Desirable materials do not undergo substantial changes in dimensions, weight, or mechanical properties after exposure to substances commonly encountered in the ear canal, including water, sweat, mineral oil, and cerumen.

Example 2

Characterization of Elastomer Tensile Strength

This example describes a procedure for testing materials for use in apparatus described herein. This procedure is used to characterize favorable qualities relating to the tensile strength of materials.

Dog bone samples, as described in Example 1, are printed and UV-cured. A 500-N load cell on an IMADA tensile test stand is used. Cross-head speed is set to 25 mm/min. Prior to testing, samples are measured for width and thickness. Each sample is loaded into the upper grip, and attached to the lower grip. Activation of the instrument provides a force, and the load force is recorded (N), along with travel distance (inches) and stress (MPa).

Five ChronoSil® 75A samples that were thermoformed and were tested to determine tensile strength, following exposure to test bath conditions (16 day standard conditions, as described in Example 1). Initial measurements are provided in Table 1.

TABLE 1

| Sample No. | Weight (g) | Length (mm) | Width (mm) | Thickness (mm) |
|---|---|---|---|---|
| Sample 1 | 0.0339 | 15.86 | 8.29 | 0.22 |
| Sample 2 | 0.0404 | 15.79 | 8.63 | 0.25 |
| Sample 3 | 0.0291 | 15.21 | 7.62 | 0.23 |
| Sample 4 | 0.0435 | 16.81 | 9.41 | 0.23 |
| Sample 5 | 0.0315 | 16.31 | 8.67 | 0.22 |

Figure 7:
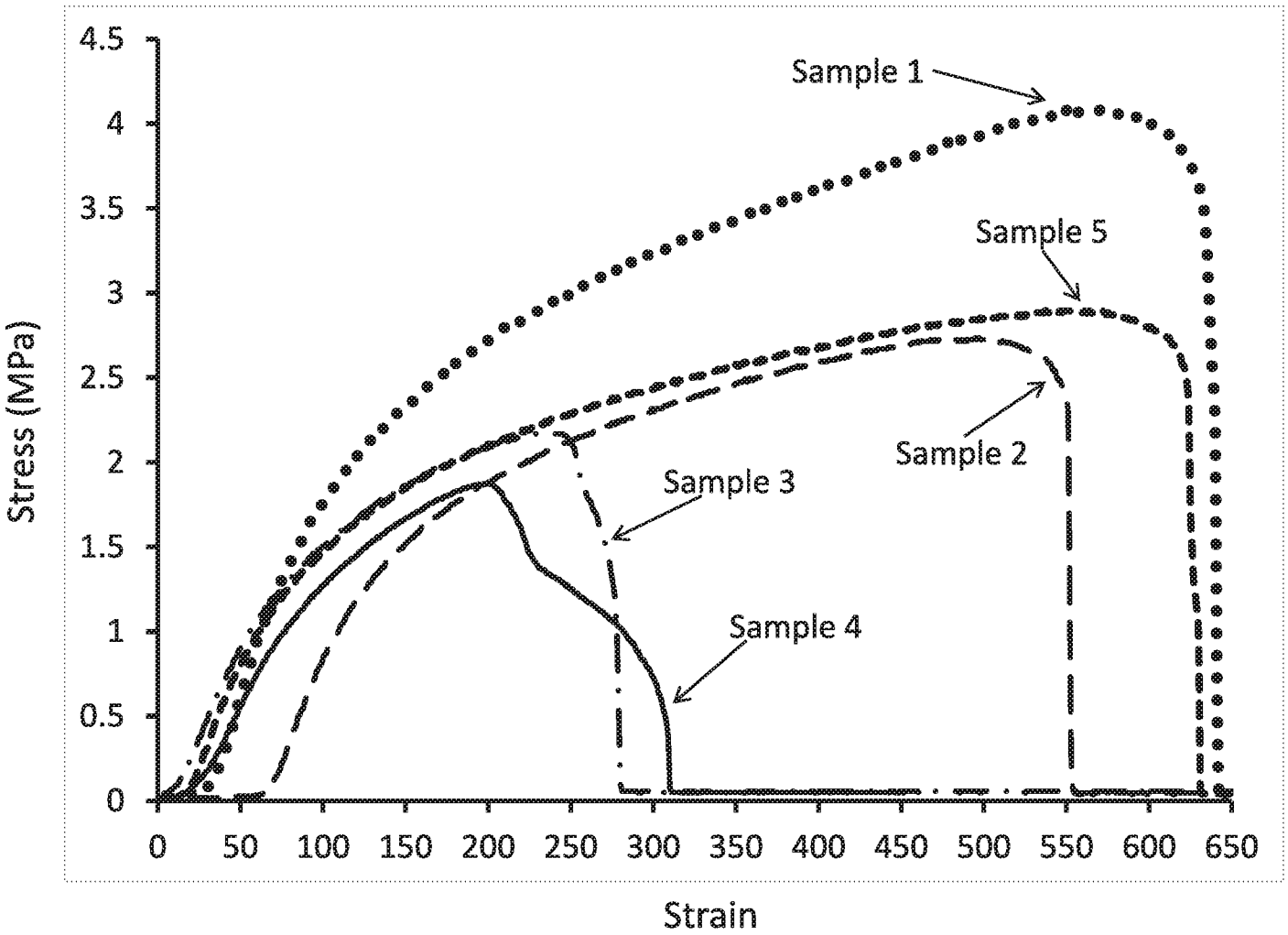
FIG. 7 is a chart displaying example tensile stress-strain curves for material samples.

As shown in FIG. 7, force was recorded as samples were stretched to induce strain. FIG. 7 depicts stress-strain curves for the ChronoSil® 75A samples. Peak force was recorded and noted. Tensile strength was calculated by dividing the peak force of each sample by the sample's thickness and width. The calculated tensile strengths are provided in Table 2.

TABLE 2

| Sample No. | Peak Force (N) | Tensile Strength (MPa) |
|---|---|---|
| Sample 1 | 7.44 | 4.07939 |
| Sample 2 | 5.90 | 2.73465 |
| Sample 3 | 3.80 | 2.16821 |
| Sample 4 | 4.60 | 1.88016 |
| Sample 5 | 5.52 | 2.89399 |

Through this protocol, tensile strength of sample materials can be determined. This procedure can similarly be used to determine information relating to materials' elastic region characteristics (e.g., Young's modulus and yield strength) and plastic region characteristics (e.g., strain hardening, necking, and fracture).

While the preferred embodiments of the devices and methods have been described in reference to the environment in which they were developed, they are merely illustrative of the principles of the present inventive concepts. Modification or combinations of the above-described assemblies, other embodiments, configurations, and methods for carrying out the invention, and variations of aspects of the invention that are obvious to those of skill in the art are intended to be within the scope of the claims. In addition, where this application has listed the steps of a method or procedure in a specific order, it may be possible, or even expedient in certain circumstances, to change the order in which some steps are performed, and it is intended that the particular steps of the method or procedure claim set forth herebelow not be construed as being order-specific unless such order specificity is expressly stated in the claim.

REFERENCE NUMBERS

| Number | Element |
|---|---|
| 100 | Contact Hearing Device (Tympanic Lens) |
| 130 | Photodetector |
| 140 | Transducer |
| 150 | Sulcus Platform |
| 155 | Perimeter Platform |
| 170 | Chassis |
| 180 | Bias Springs |
| 190 | Grasping Tab |
| 200 | Drive Post |
| 210 | Adhesive |
| 220 | Umbo Lens |
| 225 | Oil Layer |
| 240 | Membrane |
| 350 | Transducer Reed |
| 360 | Ridges (3 D Printing |
| BN | Boney Portion |
| TA | Tympanic Annulus |
| TM | Tympanic Membrane |
| EC | Ear Canal |
| UM | Umbo |

What is claimed is:

1. An apparatus for placement with a user, the apparatus comprising:

a transducer; and a retention structure comprising:

a shape profile corresponding to a tissue of the user to couple the transducer to the user, wherein the retention structure maintains a location of the transducer when coupled to the user; and a layer of elastomer, wherein the elastomer has a hardness of between 0 A and 100 A, and a thickness of between approximately 25 microns and approximately 500 microns wherein the retention structure comprises a curved portion having an inner surface toward an eardrum of the patient when placed, and wherein the curved portion couples to an ear canal wall of the patient, oriented toward the eardrum when placed to couple the transducer to the eardrum, and wherein the curved portion and the second portion are connected so as to define an aperture extending therebetween to view at least a portion of the eardrum when the curved portion couples to the first side of the ear canal and the second portion couples to the second side.

2. The apparatus of claim 1, wherein the elastomer has a Young's modulus of between 0.5 MPa and 50 MPa.

3. The apparatus of claim 1, wherein the elastomer has a hardness of between approximately 25 A and approximately 95 A.

4. The apparatus of claim 1, wherein the elastomer has an ultimate tensile strength of between 0.5 MPa and 5.0 MPa, or the elastomer has an ultimate tensile strength of between 5 MPa and 50 MPa.

5. The apparatus of claim 1, wherein the elastomer has an ultimate tensile strength of between approximately 1 MPa and approximately 300 MPa, between approximately 20 MPa and approximately 100 MPa, or between approximately 40 MPa and approximately 60 MPa at an elongation of approximately 650%.

6. The apparatus of claim 1, wherein the elastomer has a tensile stress of between approximately 2.0 MPa and approximately 4.0 MPa at 50% elongation.

7. The apparatus of claim 1, wherein the elastomer has a tensile stress of between approximately 3.0 MPa and approximately 5.0 MPa at 100% elongation.

8. The apparatus of claim 1, wherein the layer of elastomer has a change in Young's Modulus of less than 15%, less than 50%, or less than 75%, compared to a reference layer of elastomer following exposure to a test bath for 16 days at 37° C., the test bath comprising 10 wt % Synthetic Cerumen, 10 wt % EN1811 Sweat, and 80 wt % mineral oil.

9. The apparatus of claim 1, wherein the layer of elastomer has a change in weight of less than 30% compared to a reference layer of elastomer, following exposure to a test bath for 16 days at 37° C., the test bath comprising 10 wt % Synthetic Cerumen, 10 wt % EN1811 Sweat, and 80 wt % mineral oil.

10. The apparatus of claim 1, wherein the layer of elastomer has a change in wall thickness of less than 15% compared to a reference layer of elastomer, following exposure to a test bath for 16 days at 37° C., the test bath comprising 10 wt % Synthetic Cerumen, 10 wt % EN1811 Sweat, and 80 wt % mineral oil.

11. The apparatus of claim 1, wherein the layer of elastomer further comprises between approximately 5% and approximately 15% polydimethylsiloxane by weight, or wherein the layer of elastomer comprises between approximately 9% and approximately 11% polydimethylsiloxane by weight.

12. The apparatus of claim 1, wherein the layer of elastomer comprises a polyurethane, a polycarbonate urethane with a silicone rubber soft segment, a polycarbonate urethane, an aromatic polyurethane, a fluoropolymer, a polyetherurethane, a nylon, a polyetherblockamide, an aliphatic polyetherurethane, a propylene, a propylene with rubber, or any combination thereof.

13. The apparatus of claim 1, wherein the layer of elastomer comprises a polycarbonate-based silicone elastomer, a polycarbonate urethane with poly(dimethylsiloxane) soft segment, a fluoropolymer, THV [poly(tetrafluoroethylene-co-hexafluoropropylene-co-vinylidene fluoride)], a polycarbonate urethane-co-poly(dimethyl siloxane), any derivative thereof, or any combination thereof.

14. The apparatus of claim 1, wherein the layer of elastomer comprises one or more of aliphatic polycarbonate-based thermoplastic urethane, polycarbonate urethane with poly(dimethyl siloxane) soft segment, and polycarbonate urethane-co-poly(dimethyl siloxane).

15. The apparatus of claim 1, wherein the curved portion couples to the ear canal on a first side of the ear canal opposite the eardrum, and wherein a second portion of the retention structure couples to a second side of the ear canal opposite the first side to hold the retention structure in the ear canal.

16. The apparatus of claim 1, wherein the retention structure includes ridges along a tissue facing surface.

17. The apparatus of claim 16, wherein the ridges are formed as part of a three dimensional printing process.

18. The apparatus of claim 17, wherein the three dimensionally printed component is a mold used to form the layer of elastomer.

19. The apparatus of claim 1, wherein the layer of elastomer has a surface air-water contact angle of between approximately 100 degrees and approximately 130 degrees, or wherein the layer of elastomer has a surface air-water contact angle of between approximately 115 degrees and approximately 125 degrees, or wherein the layer of elastomer has a surface air- water contact angle of between approximately 20 degrees and approximately 80 degrees.

20. The apparatus of claim 1, wherein the apparatus further comprises an umbo lens, wherein the umbo lens comprises one or more of polycarbonate urethane with poly(dimethyl siloxane) soft segment or polycarbonate urethane-co-poly(dimethyl siloxane).

21. The apparatus of claim 1, wherein the apparatus further comprises a coating polymer, the coating polymer comprising a poly(p-xylylene) polymer.

22. The apparatus of claim 1, wherein the elastomer has a hardness of between 65 A and 100 A.

23. A method of treating a user in need of a hearing device, the method comprising:

providing the user with the apparatus of claim 1; and inserting the apparatus into an ear of the user, such that the transducer is in proximity to the eardrum of the user.

24. The method of claim 23, further comprising the step of administering mineral oil to the apparatus, to the ear of the user, or any combination thereof.

25. A kit, the kit comprising:

the apparatus of claim 1; and instructions for use of the apparatus.

26. The kit of claim 25, further comprising mineral oil.

27. A method of manufacturing the apparatus of claim 1, the method comprising an injection molding process.

28. A method of manufacturing the apparatus of claim 1, the method comprising a solvent coating process.

29. A method of manufacturing the apparatus of claim 1, the method comprising a 3D printing process.

* * * * *